US007597316B2

(12) United States Patent
Nakahata et al.

(10) Patent No.: US 7,597,316 B2
(45) Date of Patent: Oct. 6, 2009

(54) PAPER FEEDING METHOD AND PAPER FEEDER

(75) Inventors: Akinobu Nakahata, Nagano (JP); Keiichi Taguchi, Nagano (JP); Tomoyuki Shiiya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/957,265

(22) Filed: Dec. 14, 2007

(65) Prior Publication Data

US 2008/0099976 A1 May 1, 2008

Related U.S. Application Data

(62) Division of application No. 11/211,146, filed on Aug. 24, 2005, now abandoned.

(30) Foreign Application Priority Data

Aug. 24, 2004 (JP) ..... 2004-243877
Nov. 11, 2004 (JP) ..... 2004-327976

(51) Int. Cl.
*B65H 1/18* (2006.01)

(52) U.S. Cl. ..... 271/152; 271/155

(58) Field of Classification Search ..... 271/152, 271/155

See application file for complete search history.

(56) References Cited

U.S. PATENT DOCUMENTS 4,765,605 A * 8/1988 Abbott ..... 271/147
5,026,041 A * 6/1991 Kitazume et al. ..... 271/118
5,098,078 A 3/1992 Nakanishi
5,980,141 A 11/1999 Donnis
6,260,840 B1 7/2001 Suga et al.
6,382,622 B1 5/2002 Takada et al.
6,536,759 B1 * 3/2003 Takada ..... 271/125
6,540,221 B2 * 4/2003 Nakashima et al. ..... 271/121
6,648,323 B2 * 11/2003 Hsieh ..... 271/126
6,877,738 B2 * 4/2005 Sonoda et al. ..... 271/121
6,908,081 B2 * 6/2005 Takito et al. ..... 271/121
7,125,013 B2 * 10/2006 Sonoda et al. ..... 271/121
7,267,335 B2 * 9/2007 Kubo ..... 271/127
7,374,162 B2 * 5/2008 Sonoda et al. ..... 271/121

(Continued)

FOREIGN PATENT DOCUMENTS

EP 0393589 A1 10/1990

(Continued)

OTHER PUBLICATIONS

European Search Report for corresponding European application 05018370.6-2314 lists the references above.

*Primary Examiner*—Patrick H Mackey
*Assistant Examiner*—Howard Sanders
(74) *Attorney, Agent, or Firm*—Hogan & Hartson LLP

(57) ABSTRACT

An image-forming apparatus has a limitation pad 31*c* and a retard roller 34, which separately feed recording paper P on an elevation tray 31 in an MPT cover 30 by bringing the recording paper P against an outer peripheral surface 33*a* of the feeding roller 33. In this image-forming apparatus (paper feeder), when the feeding roller is stopped by passing recording paper to be separately fed to a pair of relay transport rollers, the elevation tray is lowered before stoppage of the feeding roller, thereby separating an extremity of the recording paper from the outer peripheral surface of the feeding roller.

2 Claims, 13 Drawing Sheets

U.S. PATENT DOCUMENTS

| | | | | |
|---|---|---|---|---|
| 7,409,184 | B2 * | 8/2008 | Kuwahara et al. | 399/365 |
| 7,523,930 | B2 * | 4/2009 | Kang | 271/152 |
| 2002/0060397 | A1 * | 5/2002 | Endo | 271/121 |
| 2003/0160381 | A1 * | 8/2003 | Sonoda et al. | 271/121 |
| 2003/0184003 | A1 * | 10/2003 | Asada et al. | 271/121 |
| 2003/0184005 | A1 * | 10/2003 | Takito et al. | 271/121 |
| 2003/0218294 | A1 * | 11/2003 | Takito et al. | 271/121 |
| 2004/0041331 | A1 * | 3/2004 | Sonoda et al. | 271/121 |
| 2004/0070137 | A1 * | 4/2004 | Sonoda et al. | 271/121 |
| 2006/0180991 | A1 * | 8/2006 | Nakahata et al. | 271/121 |
| 2007/0007711 | A1 * | 1/2007 | Suzuki et al. | 271/121 |
| 2007/0063423 | A1 * | 3/2007 | Kirby | 271/126 |
| 2007/0108696 | A1 * | 5/2007 | Yorimoto | 271/121 |

FOREIGN PATENT DOCUMENTS

| | | | |
|---|---|---|---|
| EP | 0 873 876 | | 10/1998 |
| EP | 0 994 052 | | 4/2000 |
| JP | 60-026541 | | 2/1985 |
| JP | 60-052430 | | 3/1985 |
| JP | 05039131 | A | 2/1993 |
| JP | 05186063 | A | 7/1993 |
| JP | 05-089344 | | 12/1993 |
| JP | 06064769 | A | 3/1994 |
| JP | 11-334917 | | 12/1999 |
| JP | 2004-123359 | | 4/2004 |

* cited by examiner

PAPER FEEDING METHOD AND PAPER FEEDER

CROSS-REFERENCE To The RELATED APPLICATIONS

This application is a divisional of application Ser. No. 11/211,146 filed Aug. 24, 2005, the entire contents of which are incorporated by reference. This application also claims benefit of priority under 35 U.S.C. § 119 to Japanese Patent Application No. 2004-243877 filed Aug. 24, 2004 and Japanese Patent Application No. 2004-327976 filed Nov. 11, 2004, the entire contents of both are incorporated by reference.

BACKGROUND OF THE INVENTION

The present invention relates to a paper feeding method and paper feeder.

The present invention is applicable to a paper feeding method and a paper feeder which can separately feed set paper to a desired position without fail by preventing backward movement of paper from a position where a plurality of sheets of paper are separately fed one at a time to a pickup-impossible position.

The present invention is also applicable to a paper feeding method and a paper feeder, which feed paper (plain paper, cardboard, a card, an envelope, an OHP sheet, or other recording material) stacked on a tray one at a time to an image-forming apparatus, or the like.

A paper feeder, which sets a plurality of sheets of paper in a loaded state and feeds paper by separating and feeding paper one sheet at a time to a desired position, has hitherto been used heavily. This paper feeder feeds, e.g., an original (paper) loaded in an image reader, to an image reading position. Alternately, the paper feeder is set in an image-forming apparatus, and feeds recording paper to a position where an image is to be recorded and formed (hereinafter called an "image recording-and-forming position").

The paper feeder of this type comprises: a feeding roller for downwardly feeding paper to be brought into pressed contact; a lift plate which is designed so as to be able to load a plurality of sheets of paper and which lifts or lowers a front edge thereof in a direction to come into contact with or out of contact from an outer peripheral surface of the feeding roller; and a retard roller (a separation roller) which comes into pressed contact with the outer peripheral surface of the feeding roller at a position downward of the front edge of the lift plate in a rotational direction and which is rotated so as to follow the feeding roller under the load exceeding the set value. This paper feeder enables the outer peripheral surface of the feeding roller to come into pressed contact with the front edge of paper on the lift plate, to thus directly pick up the paper. The paper is nipped between the feeding roller and the retard roller, thereby separating the paper one sheet at a time and feeding the thus-separated paper downwardly. Therefore, the paper feeder enables an attempt to reduce space and cost by omitting setting of a so-called pickup roller which picks up paper on the lift plate.

In the configuration of such a paper feeder, paper is fed downward as if it were withdrawn while being nipped between the feeding roller and the retard roller or the lift plate. Even after having been passed to a downward pair of rollers, the paper produces a great load. For this reason, in connection with the paper feeder set in the image-forming apparatus, it has been proposed to sequentially separate the lift plate and the retard roller from the feeding roller after the document has been passed to the pair of rollers downward of the feeding roller is described (see, e.g., Patent Document 1). Even in connection with the paper feeder provided in the image-forming apparatus, it is described to separate the lift plate and the retard roller from the feeding roller after a document has been passed to a pair of rollers downstream of the feeding roller (see, e.g., Patent Document 2).

Patent Document 1: JP-A-11-334917

Patent Document 2: JP-UM-A-5-89344

However, in such a conventional paper feeder, the lift plate usually has the function of lifting and lowering the front edge of paper in a pinchable manner between the lift plate and the feeding roller. If an attempt is made to provide the paper feeder with a mechanism for separating the paper from the feeding roller until arrival at the retard roller, the paper feeder must be provided with a special mechanism, as described in the above-described publications, which in turn adds to cost.

Here, the feeding roller rotates in a paper feeding direction while rotating the retard roller. In contrast, the paper fed by the feeding roller is fed to a desired position while being firmly nipped between a pair of transport rollers and a pair of gate rollers, both of which are disposed in downstream positions. For this reason, after paper has been passed to the pair of transport rollers and the pair of gate rollers, the chance of feeding accuracy of the paper being deteriorated can be lessened.

However, when the paper feeder attempts to feed paper to a processing position in the image-forming apparatus main body, there may arise a case where the feeding roller is stopped for reasons of processing of the image-forming apparatus main body. For instance, in order to make a gap (a so-called gap between sheets of paper) between a trailing edge of one sheet of paper and a front edge of a subsequent sheet of paper, the feeding roller is temporarily stopped. In particular, in the case of a paper feeder set in the image-forming apparatus, before being fed to the image recording-and-forming position, recording paper is temporarily stopped in synchronism with image-forming timing of the image-forming apparatus main body while being nipped between the pair of downstream gate rollers. At this time, thanks to recent miniaturization of equipment, in the case of a paper feeder whose path to a processing position of the image-forming apparatus main body is designed to be short, there may arise a case where the recording paper is temporarily stopped before passing through the nipping position existing between the feeding roller and the retard roller.

However, when the feeding roller is stopped while the retard roller and the lift plate remain in pressed contact with the feeding roller, load induced when the feeding roller is moved a short distance backward in reaction to stoppage of the retard roller is imparted to the feeding roller. At this time, when the front edge of paper on the lift plate remains in pressed contact with the outer peripheral surface of the feeding roller, force for backwardly moving the feeding roller is cumulatively exerted on the front edge of the paper. As a result, there arises so-called backward movement; that is, a phenomenon of paper being moved backwardly to such an extent that paper cannot be fed by bringing the paper into pressed contact with the outer peripheral surface of the feeding roller by means of the lift plate.

Accordingly, the present invention aims at providing an inexpensive paper feeder capable of reliably separating and feeding set paper to a desired position without provision of a mechanism for moving a separation roller, by preventing backward movement of paper to a position where separated feeding of paper is impossible, which would otherwise arise as a result of stoppage of a feeding roller.

Available paper feeding methods include a method for continuously feeding a plurality of sheets of paper without regard to the kind of paper while the lift plate is held in a pressing state, and a method for feeding paper by lifting or lowering the lift plate every time one sheet of paper is fed, without regard to the kind of paper.

According to the technique for continuously feeding a plurality of sheets of paper without regard to the kind of paper while the lift plate remains in a pressing state, when paper is cardboard (including a postal card, an envelope, an OHP sheet, and the like, in addition to the cardboard), the next sheet of paper becomes likely to move backward because of reaction of a torque limiter of a retard roller. Consequently, overlapping transfer of paper or transfer failure of paper becomes likely to arise.

In the meantime, according to the technique for feeding paper by lifting or lowering the lift plate every time one sheet of paper is fed without regard to the kind of paper, when paper is plain paper (including thin paper), the lift plate is lowered when the topmost paper is fed, whereby the paper is released from a supported state. Therefore, the paper trembles in the vicinity of a nipping section located between the paper feeding roller and the retard roller, thereby causing chattering sound (noise).

Another object of the present invention is to provide a paper feeding method and a paper feeder, which enable reliable feeding of cardboard one at a time simultaneously with feeding of plain paper without causing chattering sound.

SUMMARY OF THE INVENTION

A first aspect of the invention is directed toward a paper feeder for separately feeding a sheet of paper from plural sheets of paper along a transfer path. The paper feeder includes: a feed roller; and a retard roller in pressed contact with the feed roller and forming a first nip between the feed roller and the retard roller. An axis-to-axis distance between the feed roller and the retard roller is fixed. The paper feeder further includes a lift plate on which plural sheets of paper can be set, the lift plate being located in an upstream side of the transfer path with respect to the feed roller and being movable between a first position where a front end of the plural sheets of paper set on the lift plate is brought into contact with the feed roller and a second position where the front end of the plural sheets of paper set on the lift plate is separated from the feed roller. The paper feeder further includes a pair of transport rollers in contact with each other to form a second nip, and being located in a downstream side of the transfer path with respect to the feed roller. The paper feeder further includes a controller which moves the lift plate from the first position to the second position in a state in which the sheet of paper is held between the feed roller and the retard roller at the first nip and is also held between the transport rollers at the second nip.

Since the lift plate is moved from the first position to the second position in the state in which the sheet of paper is held between the feed roller and the retard roller at the first nip and is also held between the transport rollers, an adverse effect by the retard roller to a subsequent sheet of paper can be eliminated.

A second aspect of the invention is directed toward a paper feeder having: a separation-and-feeding section for separating a sheet of paper from plural sheets of paper set in a load position and feeding the sheet of paper downstream; a transport section which transports the sheet of paper sent from the separation-and-feeding section further downstream to feed the sheet of paper to a processing position on an apparatus main body; a transfer path for guiding the sheet of paper sent from the load position to the processing position by the separation-and-feeding section and the transport section; and a control section for feeding the sheet of paper from the load position to the processing position in synchronism with processing timing of the apparatus main body by controlling driving action of individual sections of the apparatus. The separation-and-feeding section includes a feeding roller for feeding, to a downstream transfer path, the sheet of paper brought into pressed contact therewith, a separation roller which is rotationally driven or subjected to limited rotation according to frictional force developing between the separation roller and the sheet of paper while bringing the sheet of paper into pressed contact with the feeding roller, thereby separating the sheet of paper from the plural sheets of paper, and a movement mechanism which is configured so as to be able to carry the plural sheets of paper and which moves an extremity of the plural sheets of paper in a direction in which the extremity is brought into contact with or separated from a portion of an outer peripheral surface of a feeding roller. The portion of the outer peripheral suraface of the feeding roller is located upstream of the separation roller. The separation-and-feeding section is designed to such a configuration that the separation roller remains pressed contact with the feeding roller at all times. The control section drives and controls the movement mechanism such that the extremity of plural sheets of paper is separated from the feeding roller at a timing when the feeding roller comes to a stop.

In this aspect, an extremity portion of the upstream plural sheets of paper can be moved so as to separate from the outer peripheral surface of the feeding roller at the timing at which the feeding roller comes to a stop while the separation roller remains in a pressed contact state. Even when the feeding roller is rotated backward as a result of reaction of the separation roller stemming from stoppage of the feeding roller, the paper located before the nipping position between the feeding roller and the separation roller can be prevented from undergoing force of backward movement. Consequently, there can be prevented backward movement of paper to such an extent that the paper cannot be separately fed, which would otherwise be caused as a result of paper being moved backward every time the feeding roller stops.

In addition to the specific items of the second aspect, a third aspect of the invention is characterized in that the transfer path is designed to have a transfer path length over which feeding of the sheet of paper to the processing position of the apparatus main body by the transport section is commenced before the sheet of paper passes through a nipping position existing between the feeding roller and the separation roller. When transfer of the sheet of paper received from the separation-and-feeding section is temporarily stopped before the sheet of paper passes through the nipping position between the feeding roller and the separation roller so that the transport section feeds the sheet of paper to the processing position in synchronism with a processing timing of the apparatus main body, the control section stops the feeding roller of the separation-and-feeding section.

In this aspect, the paper transport path is short. Even when the feeding roller comes to a temporary standstill before the sheet of paper passes through the nipping position between the feeding roller and the separation roller, paper located before the nipping position can be prevented from undergoing force of backward movement. Therefore, even in the course of paper feeding action, accumulation of force for moving backward the next paper to be separately fed can be avoided, and backward movement of paper to such an extent that the paper cannot be separately fed can be prevented with high reliability.

In addition to the specific items of the third aspect, a fourth aspect of the invention is characterized in that the control section stops the feeding roller even after the sheet of paper transported by the transport section has passed through the nipping section between the feeding roller and the separation roller.

In the fourth aspect, even when the feeding roller comes to a temporary standstill after paper has passed through the nipping position between the feeding roller and the separation roller, the paper located before the nipping position can be prevented from undergoing force of backward movement. Therefore, for instance, even when the feeding roller stops such that a clearance exists between sheets of paper to be fed, accumulation of force for moving backward the next paper to be separately fed can be avoided, so that backward movement of paper to such an extent that the paper cannot be separately fed can be prevented with high reliability.

In addition to the specific items of the second aspect, a fifth aspect of the invention is characterized in that, when transfer of the sheet of paper received from the separation-and-feeding section is temporarily stopped before the sheet of paper passes through the nipping position between the feeding roller and the separation roller so that the transport section feeds paper to the processing position in synchronism with a processing timing of the apparatus main body, the control section controls driving of the movement mechanism such that the extremity of the plural sheets of paper is separated from the feeding roller before occurrence of temporary stoppage of the paper until the sheet of paper passes through the nipping position.

In this aspect, the paper transport path is short. Even when the feeding roller comes to a temporary standstill before the sheet of paper passes through the nipping position between the feeding roller and the separation roller and when the feeding roller temporarily stops even after the sheet of paper has passed through the nipping position, the next sheet of paper to be separately fed is left in a receded position and can be prevented from undergoing force for moving the paper backward. Therefore, paper which is brought into pressed contact with the feeding roller to be separately fed does not need to be moved uselessly, and there can be avoided accumulation of force for backwardly moving the next paper to be separately fed. Thus, backward movement of paper to such an extent that the paper cannot be separately fed can be prevented with high reliability.

As mentioned above, according to the present invention, the extremity of plural sheets of paper is separated at a timing at which the feeding roller is stopped, without provision of a mechanism for moving the separation roller and while the separation roller is left in a pressed contact state. As a result, there can be prevented backward movement of paper, which would otherwise be caused by reverse rotation of the feeding roller as a result of reaction of the separation roller stemming from stoppage of the feeding roller. Backward movement of paper to such an extent that the paper cannot be separately fed, which would otherwise be caused by accumulation of backward movement of paper, can be prevented. Therefore, by means of only an inexpensive configuration which actuates an existing mechanism for bringing the extremity of plural sheets of paper into pressed contact with an outer peripheral surface of the feeding roller, set paper can be separately fed to a desired position with high reliability.

A sixth aspect of the invention is directed toward a paper feeding method for a paper feeder including a paper feeding roller which comes into contact with a topmost sheet of paper in stacked sheets of paper to thereby feed the topmost sheet of paper, a retard roller which comes into contact with the paper feeding roller to separate the topmost sheet of paper from a subsequent sheet in the stacked sheets of paper, and a lift plate which supports stacked sheets of paper and presses a front portion of stacked sheets of paper against the paper feed roller. In the method, when the paper is plain paper, paper is fed while the lift plate remains pressed. When the paper is cardboard, paper is fed by lifting/lowering the lift plate every time one sheet of cardboard paper is fed.

A seventh aspect of the invention is directed toward a paper feeder including: a paper feeding roller which comes into contact with a topmost sheet of paper in stacked sheets of paper to thereby feed the topmost sheet of paper; a retard roller which comes into contact with the paper feeding roller to separate the topmost sheet of paper from a subsequent sheet of paper in the stacked sheets of paper; a lift plate which supports stacked sheets of paper to and presses a front portion of the stacked sheets of paper against the paper feed roller; a lift plate lifting-and-lowering mechanism for lifting or lowering the lift plate; and a controller which selects either a plain paper mode, where paper is fed while the lift plate remains pressed by the lift plate lifting-and-lowering mechanism when the paper is plain paper, or a cardboard mode, where paper is fed while the lift plate is lifted and lowered every time one sheet of cardboard is fed by the lift plate lifting-and-lowering mechanism when the paper is cardboard.

According to the sixth and seventh aspect, when paper to be fed is plain paper, paper is fed while the lift plate remains pressed. Hence, the lift plate becomes pressed (lifted) when the topmost sheet of paper is fed, whereby supporting of paper is achieved.

Therefore, occurrence of tremble vibrations in paper, which would otherwise arise in the vicinity of a nipping section between the paper feeding roller and the retard roller, is prevented, which in turn suppresses occurrence of chattering sound (noise).

Further, when paper to be fed is plain paper, paper is fed while the lift plate remains pressed. There is no necessity for lifting or lowering the lift plate every time one sheet of paper is fed. Hence, a plurality of sheets of plain paper can be continuously fed with efficiency.

In contrast, when paper to be fed is cardboard, the lift plate is lifted and lowered every time one sheet of cardboard is fed. Therefore, even when the next sheet of paper has been moved rearward by means of reaction of a torque limiter of the retard roller, the extent to which the next sheet of paper is moved rearward is diminished by the lifting-and-lowering actions of the lift plate.

Consequently, overlapping transfer of paper or transfer failure of paper, which would otherwise be caused when paper is cardboard, is unlikely to arise.

As mentioned above, according to the present invention, cardboard can be fed one sheet at a time without fail, and plain paper can be fed without causing chattering sound.

Preferably, the paper feeder further includes a first tray which has the lift plate and is tilted with respect to the a horizontal plane; and a second tray which is coupled to a rear portion of the first tray, supports the rear portion of the paper, and makes a smaller tilt angle with respect to the horizontal plane than that formed by the first tray. A paper support face of the second tray falls within a range of angle made between a paper support face of the lift plate achieved at a position where the lift plate is lifted when a maximum number of sheets of paper that can be set on the first tray are stacked on the first tray and a paper support face of the lift plate achieved at a position where the lift plate is lifted when one sheet of paper is supported by the first tray.

In this case, the paper support face of the second tray achieved when the maximum number of sheets of paper that can be set on the first tray are stacked on the first tray turns into a slope which makes the same angle as that made between the horizontal plane and the paper support face of the lift plate achieved at the position where the lift plate is lifted, or turns into a slope which makes a smaller angle of inclination with respect to the horizontal plane.

Consequently, occurrence of a downward flexion in the paper support plane of the lift plate and the paper support face of the second tray, which would otherwise arise when the lift plate has lifted the front portion of paper, is prevented. Even when the stacked paper is cardboard, both ends of the cardboard are not supported, whereby a transfer failure of paper is unlikely to arise.

Meanwhile, the paper support face of the second tray achieved when one sheet of paper is supported by the first tray turns into a slope which forms the same angle as that made between the horizontal plane and the paper support plane of the lift plate achieved in the position where the lift plate is lifted, or turns into a slope which makes a larger angle of inclination with respect to the horizontal plane.

Consequently, when a plurality of sheets of paper are set in the first tray (and the second tray), even when force—which causes rearward movement by reaction of the torque limiter—has been exerted on the next sheet of paper as a result of use of a retard roller having a torque limiter, the paper becomes easy to slip over the slope (or the upper surface of paper), and hence overlapping transfer or transfer failure of paper becomes unlikely to arise.

This paper feeder can yield an additional advantage of the ability to feed a plurality of sheets of paper one by one without fail until the last sheet of paper.

Desirably, lifting/lowering of the lift plate performed when the paper is cardboard is effected by: lowering the lift plate after one sheet of cardboard has been fed and before a trailing edge of the cardboard passes through a contact section between the paper feeding roller and the retard roller, and lifting the lift plate before initiation of feeding of a next sheet of cardboard.

In this case, the lift plate has been lowered before the trailing edge of the cardboard passes through a contact section between the paper feeding roller and the retard roller. Hence, rearward movement of the next sheet of paper, which would otherwise be caused by reaction of the torque limiter of the retard roller, can be reliably prevented.

The present disclosure relates to the subject matter contained in Japanese patent application Nos. 2004-243877 (filed on Aug. 24, 2004) and 2004-327976 (filed on Nov. 11, 2004), each of which is expressly incorporated herein by reference in its entirety.

BRIEF DESCRIPTION OF THE DRAWINGS

FIG. 2 is a view for describing a mechanism for opening and dosing an exterior cover of the image-forming apparatus, wherein FIG. 2A is a phase diagram of the exterior cover when the cover is closed, and FIG. 2B is a phase diagram of the exterior cover when the cover is opened.

DESCRIPTION OF THE PREFERRED EMBODIMENT

The best mode of the present invention will be described hereinbelow by reference to the drawings.

First Embodiment

FIGS. 1 through 7 are drawings showing an example image-forming apparatus equipped with one embodiment of a paper feeder of the present invention.

Figure 1:
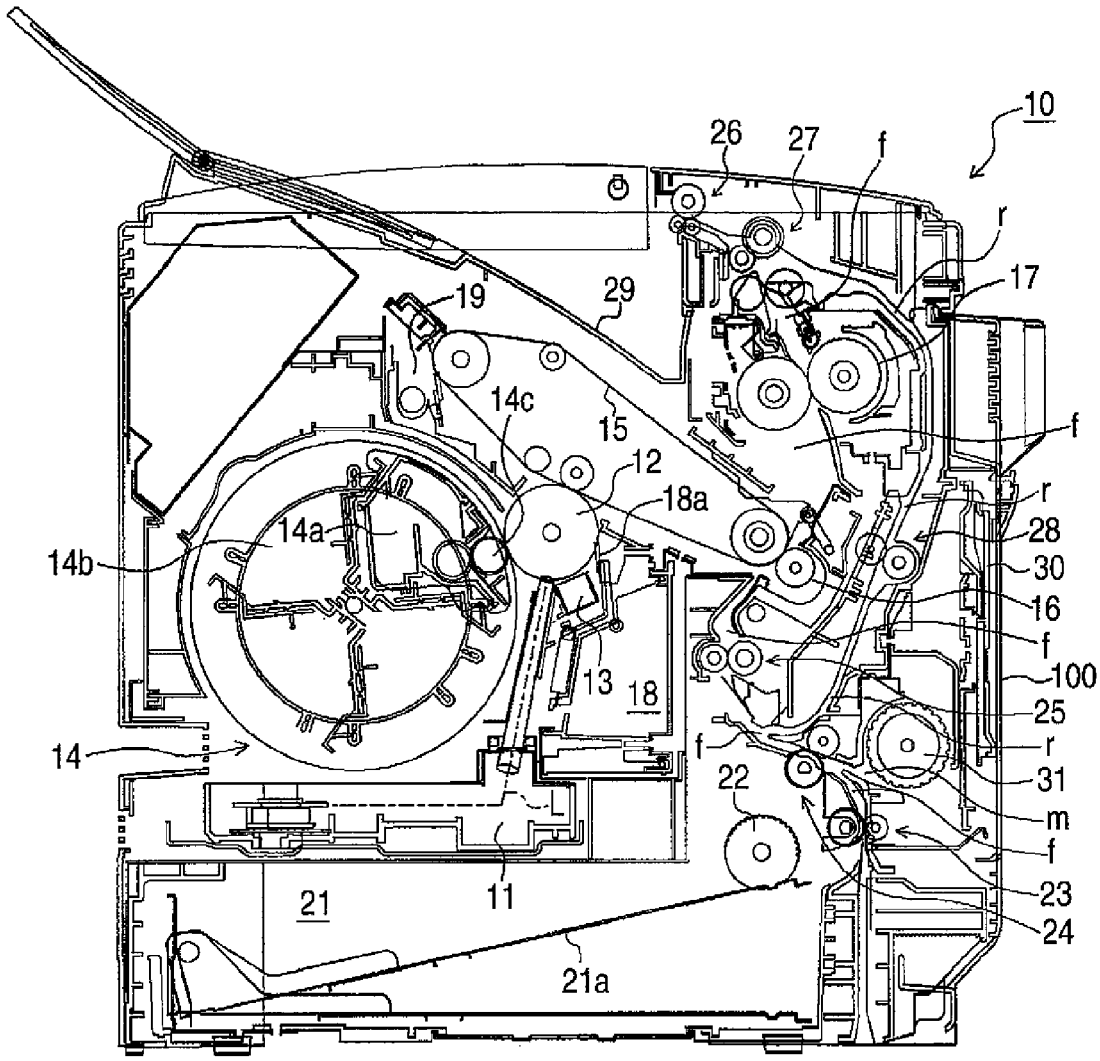
FIG. 1 is a view showing an example image-forming apparatus equipped with an embodiment of a paper feeder of the present invention; that is, a front perspective view showing the substantially-entire configuration thereof.

In FIG. 1, an image-forming apparatus 10 is a printer which is connected to and utilizes an external device, such as a personal computer, which prepares and outputs an image such as characters. This image-forming apparatus 10 comprises an image recorder which receives image data used for forming an image, such as characters, and records and forms an image on one or both sides of recording paper by means of electrophotography; and a paper transport device which separately feeds a plurality of sheets of loaded recording paper one at a time to the image recorder and which transports the recording sheet, on which the image has been recorded and formed, to the outside of the image-forming apparatus and stacks the thus-transported recording paper.

In simple terms, the image recorder comprises: a laser beam scanning device 11 for effecting scanning of a laser beam L on the basis of image data; a photosensitive drum (image-carrying body) 12 which is exposed to radiation and scanning of the laser beam L emitted from the laser beam scanning device 11, whereby an electrostatic latent image based on image data is formed on the surface of the photosensitive drum 12 through exposure; an electrifying device 13 for electrifying an outer peripheral surface of the photosensitive drum 12 so that an electrostatic latent image can be formed by means of radiation of the laser beam L; development cartridges 14*a* (only one of which is illustrated) of respective colors which store toner of yellow (Y), cyan (C), magenta (M), and black (K) color and transfer the toner to the electrostatic latent image on the photosensitive drum 12 by means of a development roller 14*c*, to thus cause the toner to adhere to the latent image, thereby effecting toner development; a rotary development device 14 which houses the development cartridges 14*a* in setup spaces 14*b* of respective colors and which performs switching of the development cartridges 14*a* to be operated (used for development) while facing the photosensitive drum 12; an intermediate transfer belt (an intermediate transfer medium) 15 which receives the toner images of respective colors developed on the photosensitive drum 12 and forms a transferable-and-recordable toner image (a monochrome image or a color image) on the recording paper; a transfer roller 16 which transports the conveyed and fed recording paper downstream such that the recording paper is nipped between the transfer roller 16 and the intermediate transfer belt 15 and which transfers the toner image carried by the intermediate transfer belt 15 to the nipped and transported recording paper; a pair of fusing rollers 17 which fuse the toner image by subjecting the recording paper, on which the toner image has been transferred and which has been transported, to heating and pressed contact and which transports the recording paper in a nipped manner in a further downstream direction; a waste toner tank 18 which recovers the toner still remaining on the photosensitive drum 12 by means of a blade 18*a* and stores the thus-recovered toner; and a waste toner tank 19. Which, similarly, recovers the toner still remaining on the intermediate transfer belt 15 by means of a blade and stores the thus-recovered toner. The intermediate transfer belt 15, the transfer roller 16, and the pair of fusing rollers 17, all of which belong to the image recording device, each have the function of transporting the recording paper. For this reason, the intermediate transfer belt 15, the transfer roller 16, and the pair of fusing rollers 17 constitute a portion of the paper transport device to be described below.

In simple terms, the paper transport device comprises: a paper cassette 21 which is removably set in a lower portion of the image-forming apparatus main body 10 and which houses a plurality of sheets of recording paper loaded on an elevation plate 21*a* at the bottom; a pickup roller 22 which is brought into pressed contact with a bundle of sheets of recording paper lifted by a lift plate 21*a* of the paper cassette 21 and which rotates so as to be pressed against a separation pad 21*b*, thereby picking up (withdrawing) the topmost sheet of recording paper and delivering the thus-picked-up sheet of recorded paper to a paper transport path "f"; a pair of first relay transport rollers 23 which receive the recording paper fed from the paper cassette 21 by the pickup roller 22 and transport the thus-received recording paper in a nipped manner to the downstream transport path 'f'; a pair of second relay transport rollers 24 which receive the recording paper transported in a nipped manner by the pair of first relay transport rollers 23 and transport the thus-received recording paper to a further downstream transport path "f"; a pair of gate rollers (so-called registration rollers) 25 which receive the recording paper transported by the pair of second relay transport rollers 24 in the transport path 'f' and transport (feed), in a nipped manner, the thus received recording paper to a position where an image is recorded and formed (transferred) by the intermediate transfer belt 15 and the transfer roller 16, both of which belong to the image recording device; and a pair of first paper output rollers 26 and a pair of second paper output rollers 27 which receive from the pair of gate rollers 25 the recording paper—on one surface of which the image has been fused as a result of the recording paper having been transported over the transport path "f" between the intermediate transfer belt 15 and the transfer roller 16 and between the pair of fusing rollers 17—and transport and output, in a stacking manner, the thus-received recording paper to a paper output table 29 located in the upper portion of the image-forming apparatus main body 10. This paper transport device has a re-transport path "r" which inverts the recording paper, on one surface of which the image is formed, and delivers the thus-inverted recording paper to the transport path "f" upstream of the pair of gate rollers 25; and a pair of third intermediate transport rollers 28 disposed in the path "r." The pair of third intermediate transport rollers 28 receive the recording paper that has been delivered to the re-transport path "r" as a result of reverse rotation of the pair of first and second paper output rollers 26, 27, and pass the thus-received recording paper to the pair of gate rollers 25, whereby images can be formed on both surfaces of the recording paper.

As a result, the image-forming apparatus 10 can form images by transferring, on one surface or both surfaces of the recording paper by way of the intermediate transfer belt 15, the toner images that have been formed by causing toner to adhere to the surface of the photosensitive drum 12 to thus develop the electronic latent image. In this way, an image can be formed by transferring, to the recording paper, the color image that has been formed by superimposing yellow (Y), cyan (C), magenta (M), and black (K) toner on the surface of the intermediate transfer belt 15, or transferring a monochrome image formed from black (K) toner to the recording paper.

A reclosable cover (an exterior cover) 100 is provided on a side surface, shown in FIG. 1, of the paper transport device of the image-forming apparatus 10 so as to enable opening and closing of the inside of the image-forming apparatus main body 10. A cover (general-purpose cover) 30 for use with a multipurpose tray—which carries a plurality of types of recording paper used for interrupt processing other than paper fed from the paper cassette 21—is provided integrally and reclosably in the reclosable cover 100. This paper transport device has an MPT transport path "m" used for feeding the recording paper set on this multipurpose tray cover (hereinafter abbreviated as an "MPT cover") 30 to the transport path 'f' upstream of the pair of gate rollers 25. An MPT feeding roller 33 disposed in the MPT transport path "m" separately feeds the recording paper one at a time, thereby passing the recording paper to the pair of second intermediate transport rollers 24 and the pair of gate rollers 25. As a result, the recording paper can be fed to a position where an image is recorded and formed by means of the intermediate transfer belt 15 and the transfer roller 16, both belonging to the image-recording device, whereby an image can be formed on the recording paper.

Figure 2:
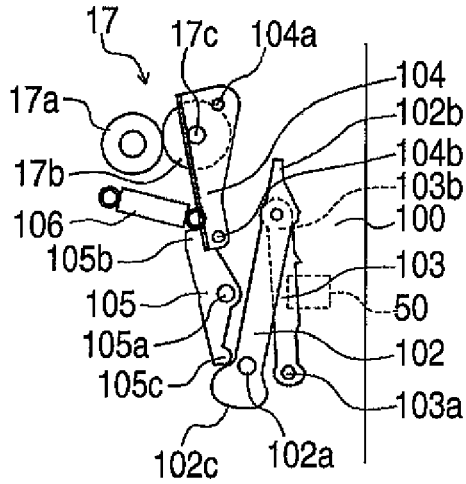
Figure 2:
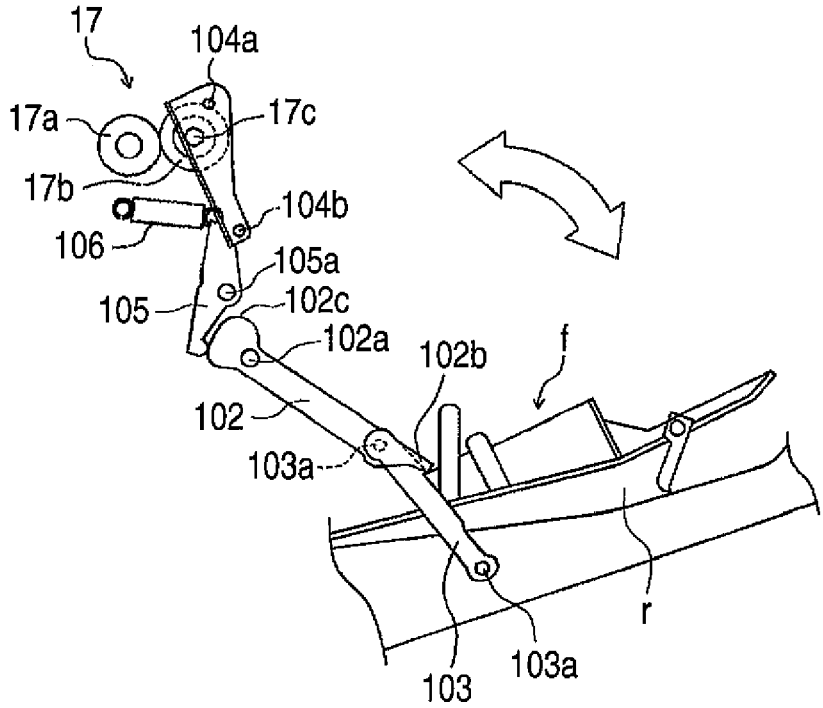

Specifically, in this image-forming apparatus 10, the reclosable cover (exterior cover) 100 on the side is pivotally supported by rotary shafts provided on both lower ends. As shown in FIG. 2, the reclosable cover 100 is supported so as not to unlimitedly pivot and fall, by means of link members 102 to 105, which are attached to positions on both sides of the transported recording paper in a transverse direction thereof to thus constitute a link mechanism, and a traction spring 106. As a result, an upper edge of the reclosable cover 100 is pivoted in a direction approaching and departing from the image-forming apparatus main body 10 (a horizontal direction in FIG. 1) by detaching an unillustrated lock mechanism, thereby opening and closing the inside of the image-forming apparatus main body 10. The reclosable cover is pivoted in a clockwise direction in FIG. 1 to thus provide access to the inside of the image-forming apparatus main body 10. As a result, there can be performed operation for removing the recording paper having jammed during the course of transportation, by releasing (exposing) the transport paths "f" and "r" of the paper transport device. The photosensitive drum 12 in the image recording device and the development cartridges 14*a* in the rotary development device 14 can be subjected to maintenance by opening and closing an unillustrated front reclosable cover.

In the link members 102, 103 of the link mechanism, base end sections 102*a*, 103*a* are pivotally attached to the image-forming apparatus main body 10 and the reclosable cover 100, respectively, and extremity sections 102*b*, 103*b* are coupled so as to be able to relatively pivot, thereby allowing the reclosable cover 100 to approach and depart from the image-forming apparatus main body 10. As shown in FIG. 2A, the reclosable cover 100 can close the link members 102, 103 in a collapsed manner. As shown in FIG. 2B, when the reclosable cover 100 is opened, the link members 102, 103 are pivoted so separate the base end sections 102*a*, 103*a*, whereby the link members 102, 103 can be supported in a suspended manner on a part of the image-forming apparatus main body 10 and maintained at a set release (pivot) angle.

In the link member 102, an outer peripheral surface of the base end section 102*a* is formed into a cam surface 102*c*. The link members 104, 105 are coupled to the cam surface 102*c*, to thus limit pivotal movement of the link members 102, 103. Thus, pivotal movement (releasing action) of the reclosable cover 100 is adjusted to be stopped in a multistage manner.

In more detail, the link member 104 axially supports a rotary shaft 17*c* of one roller 17*b* of the pair of fusing rollers 17. The link member 104 is pivotally attached to the image-forming apparatus main body 10 by taking an upper portion of the rotary shaft 17*c* as a pivot 104*a*. The traction spring 106, which urges the fusing roller 17*b* in a direction approaching the other fusing roller 17*a* to thus impart pressing force, is attached to the extremity of the link member 104 which is spaced from the pivot 104*a* to a position lower than the rotary shaft 17*c*. The link member 105 is pivotally attached to the image-forming apparatus main body 10 while taking an intermediate portion of the link member 105 as a pivot 105*a*. One end section 105*b* of the link member 105 remains in pressed contact with a pin 104*b* located at the extremity of the link member 104 pulled by the traction spring 106, and the other end section 105*c* remains in slidable contact with the cam surface 102*c* of the link member 102.

The cam surface 102*c* of the link member 102 is designed to pivot the link member 105 by changing an interval between the position where the cam surface 102*c* comes into slidable contact with the other end section 105*c* of the link member 105 and the base end section 102*a* of the pivot, in accordance with the amount of pivotal movement. When the reclosable cover 100 is stopped, the traction spring 106 is allowed to pull the link member 104 in a direction where the fusing roller 17*b* is brought into pressed contact with the fusing roller 17*a*. In contrast, when the reclosable cover 100 is released, the link member 104 is pivoted in a direction where the fusing roller 17*b* is caused to depart from the fusing roller 17*a* in defiance of the restoration force (elastic force) of the traction spring 106. The pair of fusing rollers 17 (17*a*, 17*b*) are released from a pressed-contact state, thereby releasing nipping pressure for nipping the recording paper. The reclosable cover 100 does not naturally return from a released state to a closing direction, which would otherwise be caused when the restoration force of the traction spring 106 has surpassed pivotal force stemming from the weight of the reclosable cover 100.

As a result, when released from the lock of the image-forming apparatus main body 10, the reclosable cover 100 attempts to pivot in an opening direction. However, pivotal movement of the link members 102, 103 is limited by the link members 104, 105 pulled by the traction spring 106 joined to the cam surface 102*c* of the link member 102, and the link members 102, 103 are held in their pivotal positions. Consequently, the reclosable cover 100 is retained at the position where an upper portion of the reclosable cover 100 is slightly opened. Thus, occurrence of fracture or impact sound, which would otherwise be caused when the reclosable cover abruptly pivots and falls to a fully-opened position shown in FIG. 2B, can be prevented.

Figure 3:
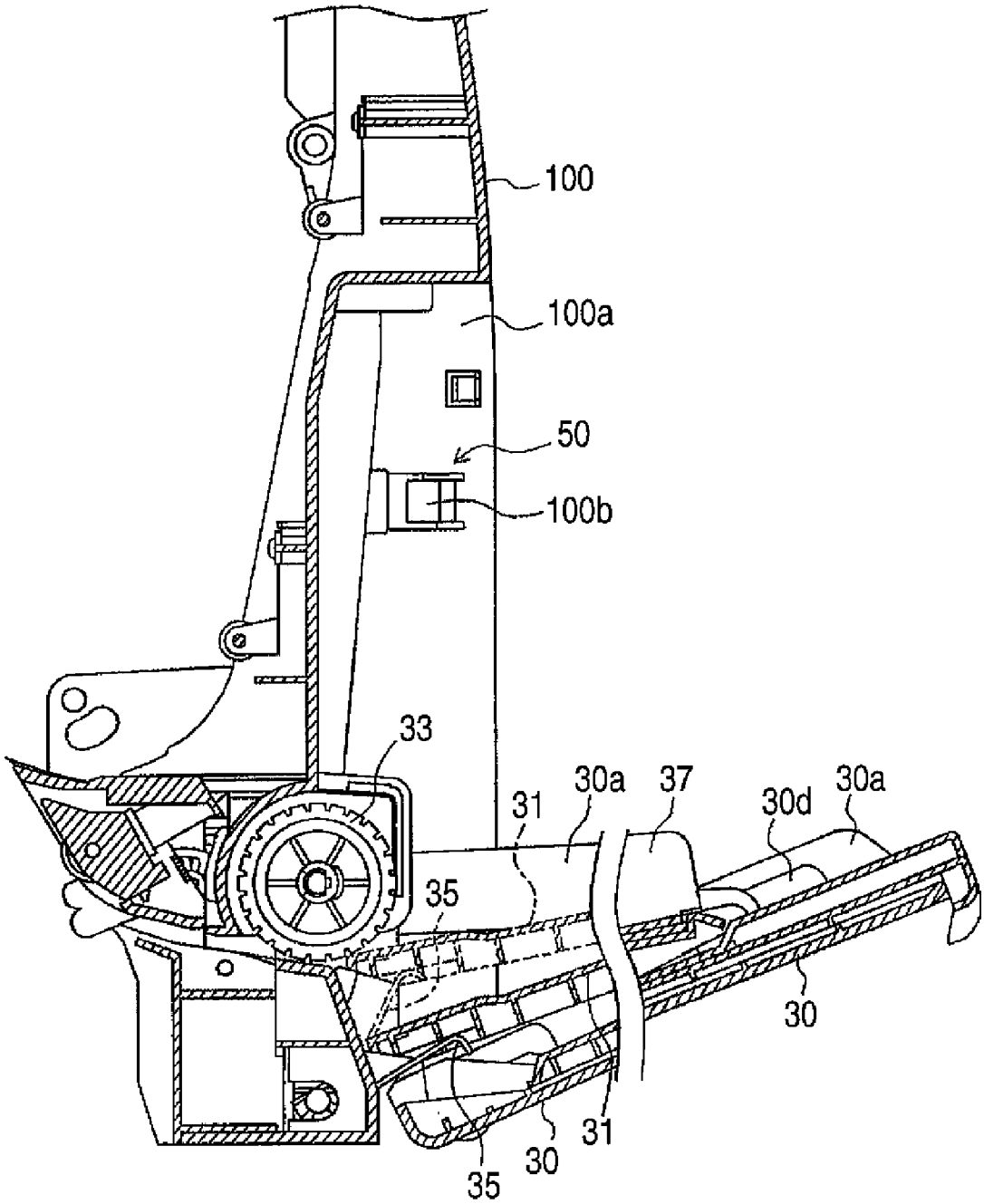
FIG. 3 is a view showing that an MPT cover is opened so as to make available a multipurpose tray (MPT) set on the exterior cover; that is, a fragmentary cross-sectional side view of the cover.

As shown in FIG. 3, the MPT cover 30 is integrally provided inside of the reclosable cover 100 with a portion of the MPT cover located close to the outer edge of the reclosable cover 100 being left outside. As in the case of the reclosable cover 100, the MPT cover 30 is pivotally supported by the pivots located on both lower ends. As a result of the upper end portion of the MPT cover 30 being pivoted in a direction (a horizontal direction in FIG. 1) in which the MPT cover approaches and departs from the reclosable cover 100, the MPT transport path "m" in communication with the transport path 'f' can be opened or closed. A closing mechanism 50 maintains the MPT cover 30 such that the exterior surface of the MPT cover 30 becomes essentially flush with the reclosable cover 100. This dosing mechanism 50 comprises an engagement piece 100*b* formed into the shape of a tongue by cutting a wall surface 100*a* of a recessed section of the reclosable cove 100; and an elongated engagement hole 30*d* formed by cutting a side wall 30*a* of the MPT cover 30. Specifically, the engagement piece 100*b* of the reclosable cover 100 advances or recedes in the front-and-back direction of drawing paper of FIG. 3 by means of only pivoting the reclosable cover 100 in an approaching/departing direction with an unillustrated grip section provided on the upper end of the MPT cover 30 (by only applying force for opening/closing the MPT cover 30). As a result, the engagement piece 100*b* is engaged with or disengaged from the elongated engagement hole 30*d*, so that the MPT cover 30 can be held in either a closed state or an open state.

Figure 4:
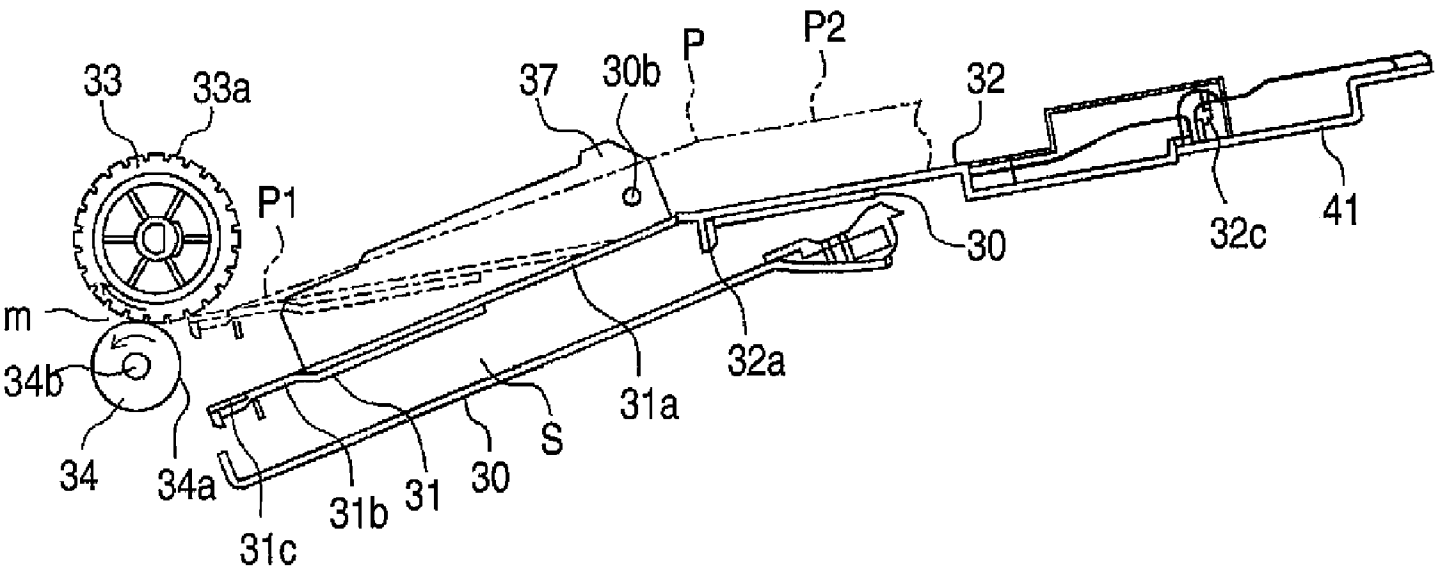
FIG. 4 is a perspective side view showing the multipurpose tray of the exterior cover.
Figure 5:
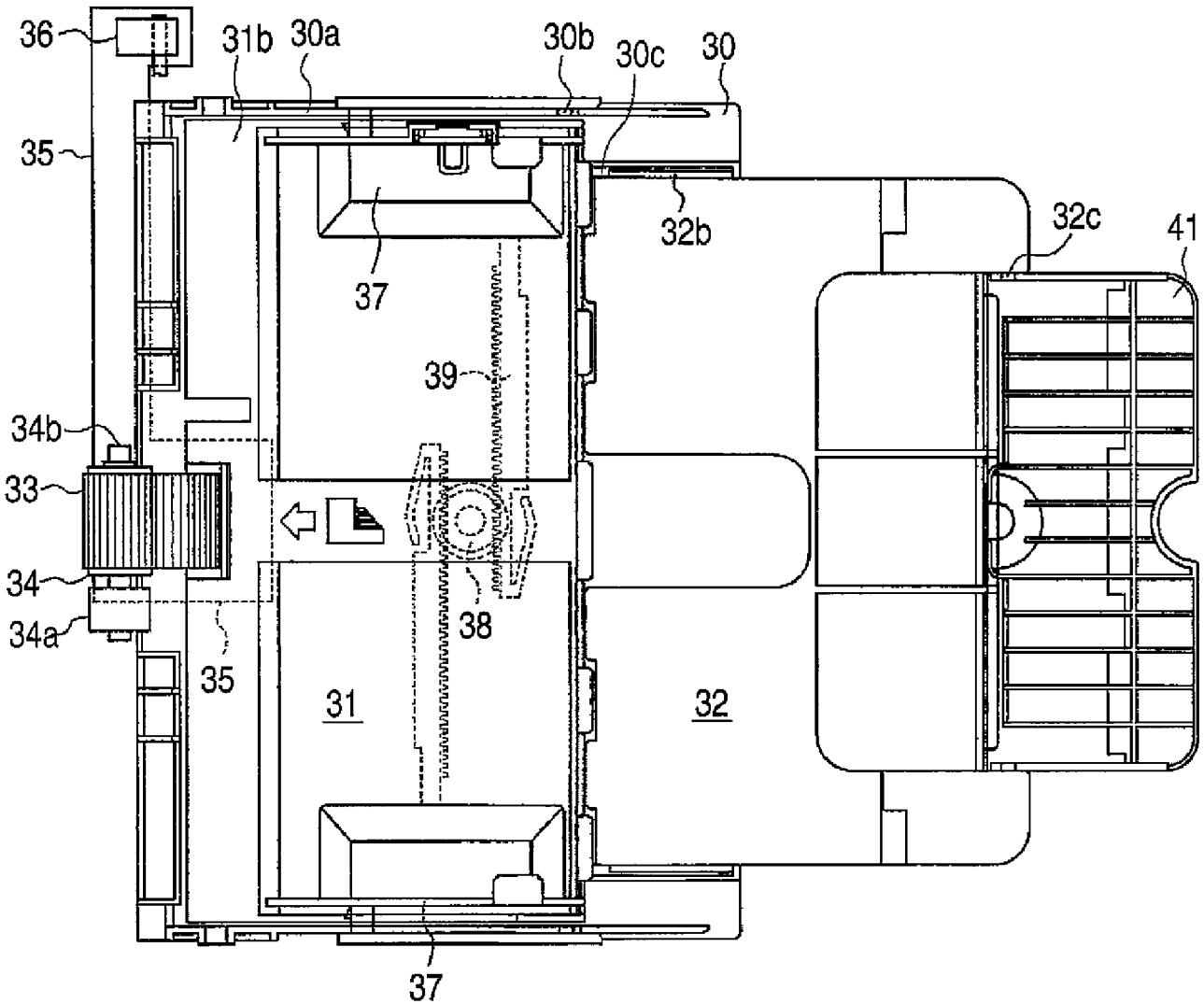
FIG. 5 is a plan view showing the multipurpose tray of the exterior cover.

When the MPT cover 30 is pivoted in such a direction that the upper end thereof departs from the reclosable cover 100 (in the clockwise direction in FIG. 3), the portion of the MPT cover 30 close to the lower end thereof is supported by the reclosable cover 100 so as to guide the set recording paper to the MPT transport path "m" and such that the external upper end of the MPT cover comes to an elevated position. As shown in FIGS. 4 and 5, the feeding roller 33 and the retard roller (the separation roller) 34 are opened (exposed) in an available manner in conjunction with an elevation tray 31 and an extended tray 32, both of which are provided inside as MPT trays. The recording paper P set on the elevation tray 31 or the extended tray 32 is separately fed to the MPT transport path "m" one at a time by means of the feeding roller 33 and the retard roller 34. Specifically, the elevation tray 31, the extended tray 32, the feeding roller 33, and the retard roller 34 constitute a separation feeding section. The pair of relay transport rollers 24 and the pair of gate rollers constitute a transport section, and the transport paths "f" and "m" constitute a transfer path.

The elevation tray 31 is supported by a pivot 30*b* provided on an interior surface of the side wall 30*a* of the MPT cover 30 such that a rear end section 31*a* departed from the image-forming apparatus main body 10 is pivotally supported. A limitation pad 31*c* is provided in the center of an extremity section 31*b* so as to be able to approach or depart from the feeding roller 33 provided in the image-forming apparatus main body 10. As shown in FIG. 3, the lift plate 35, which is connected in communication with the image-forming apparatus main body 10 and vertically moves, is situated between the elevation tray 31 and the MPT cover 30 located below. While being forced upwardly at all times by an unillustrated forcing member (e.g., a torsion spring), the lift plate 35 is pressed downward in defiance to the force of the forcing member in accordance with a rotational angle of an eccentric cam 36 (shown in FIG. 5) which is rotationally driven by a controller (control section) 40 to be described later. As a result, the lift plate 35 is vertically moved. Specifically, the elevation tray 31, the lift plate 35, and the eccentric cam 36 constitute a movement mechanism. The extremity P1 of the recording paper P set on the upper surface of the elevation tray 31 can be caused to approach or depart from an outer peripheral surface 33*a* of the feeding roller 33. This elevation tray 31 can limit withdrawal of the recording paper P pressed against the outer peripheral surface 33*a* of the feeding roller 33 by means of the limitation pad 31*c*. The frictional surface of the limitation pad 31*c* is set to such an extent that withdrawal of the final one sheet of recording paper P is withdrawn by the outer peripheral surface 33*a* of the feeding roller 33.

The elevation tray 31 is provided with a pair of side guides 37 separated from each other in the widthwise direction (the vertical direction in FIG. 5) of the set recording paper P. The side guides 37 are provided so as to be slidable in the widthwise direction while maintained upright on the upper surface of the elevation tray 31. The side guides 37 extend in the widthwise direction of the recording paper P on the back of the elevation tray 31, and are coupled to a pair of racks 39 separated in a lengthwise direction (the horizontal direction in FIG. 5) of the recording paper P. The racks 39 mesh with a pinion 38 arranged in the center between the racks 39. As a result, the side guides 37 are designed to slide evenly in the widthwise direction of the recording paper P on the elevation tray 31, thereby restricting the side edges of the recording paper. As a result, the recording paper P is separately fed to the MPT transport path "m" while being oriented in an appropriate attitude.

The extended tray 32 is inserted and housed in a space S defined between the back surface of the elevation tray 31 and the MPT cover 30. When the recording paper is loaded on the elevation tray 31, the extended tray 32 is designed to be withdrawn to support a trailing edge section P2 of the recording paper P. This extended tray 32 is supported by the MPT cover 30 in such an attitude as to become essentially flush with an extended plane of the elevation tray 31 (illustrated by a dashed line in FIG. 4) that causes the extremity section 31*b* to approach the outer peripheral surface 33*a* of the feeding roller 33 when the extended tray 32 is withdrawn. When the extended tray 32 is withdrawn, protrusions 32*a* provided at the extremity of the extended tray 32 catch ribs 30*c* provided upright on the side walls 30*a* of the MPT cover 30, thereby preventing removal of the extended tray 32. Extended sides 32*b* formed on both sides of the extended tray 32 are supported so as to assume a desired attitude by the ribs 30*c* of the MPT cover 30. An auxiliary tray 32*d* is provided on a rear end section of the extended tray 32 so as to be pivotable around a pivot 32*c*. When very long recording paper P is set on the elevation tray 31, the auxiliary tray 32*d* is pivoted, thereby enabling extension of a load surface.

The feeding roller 33 is provided in a position corresponding to the limitation pad 31*c* in the center of the extremity section 31*b* of the elevation tray 31. The feeding roller 33 is rotationally driven by the controller 40 to be described later. This feeding roller 33 rotates clockwise in FIG. 4 to pick up (withdraws) the recording paper P on the elevation tray 31, on the outer peripheral surface 33*a* of which the extremity section P1 is pressed, and feeds the thus-picked-up recording paper to the MPT transport path "m."

The retard roller 34 is rotationally supported while the feeding roller 34 remains in pressed contact with the outer peripheral surfaces 33*a*, 34*a*, and is attached to a stationary shaft 34*b* fixed in a nonrotatable manner to the image-forming main body 10, so as to rotate in conjunction with a torque limiter 34*c*. The torque limiter 34*c* is set as follows. When the outer peripheral surface 33*a* of the feeding roller 33 and an outer peripheral surface 34*a* of the retard roller 34 are in direct pressed contact with each other or in direct pressed contact with the recording paper P withdrawn by the feeding roller 33, the retard roller 34 is rotationally driven by the feeding roller 33 by means of frictional force developing therebetween. Meanwhile, the retard roller 34 is stopped by the frictional force developing between the retard roller 34 and the recording paper P withdrawn by the feeding roller 33, thereby stopping the recording paper P remaining in a pressed contact with the retard roller.

Figure 6:
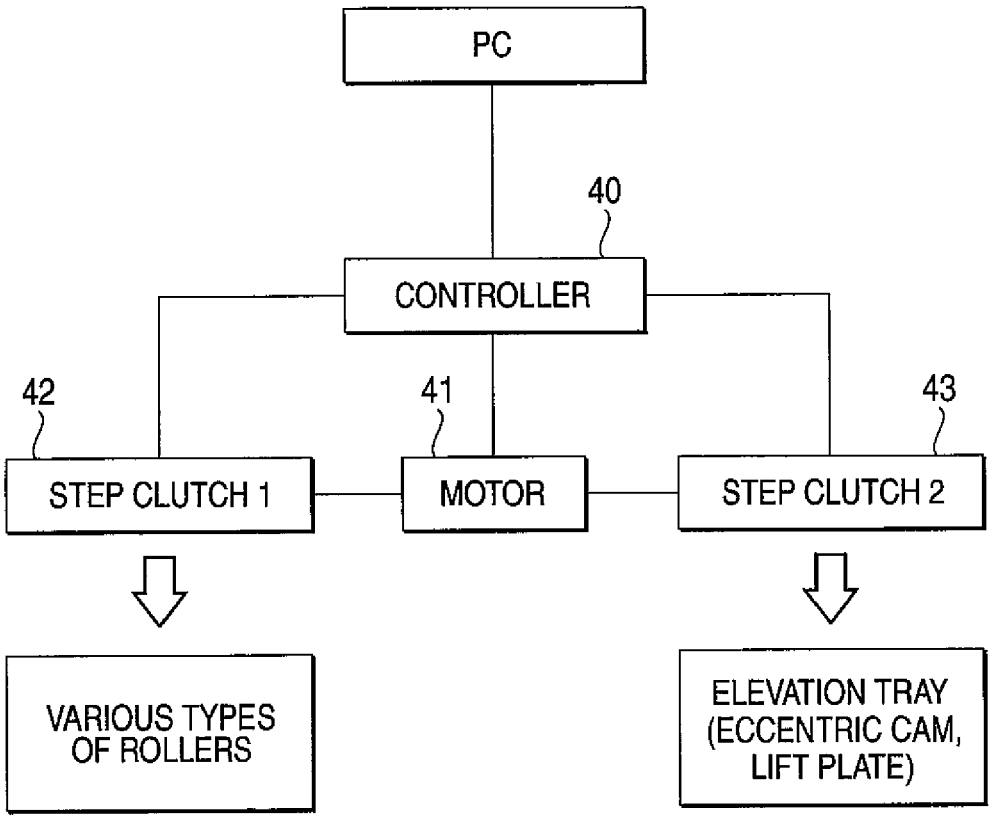
FIG. 6 is a related block for describing controlling of feeding of paper from the multipurpose tray.

As shown in FIG. 6, the controller 40 is connected to, e.g., a personal computer PC which prepares and outputs an image, such as characters, and exchange various types of control data and image data with the PC. In accordance with previously-prepared programs, various types of data processing control operations and drive control operations of individual sections of the image-forming apparatus are performed. As a result, the individual sections of the image-forming apparatus 10 are collectively controlled, to thus form an image on the recording paper P and produces a printout.

In this controller 40, for example, a group of motors 41 for driving individual sections of the controller and step clutches 42, 43 coupled to the group of motors by way of an unillustrated gear trains so as to be able to transmit driving force from drive shafts of the motors 41. The step clutch 42 is coupled to an unillustrated drive gear for rotationally driving various types of drive rollers, such as the pickup roller 22 and the feeding roller 33. The controller 40 connects or disconnects transmission of driving force of the motors 41 to the feeding roller 33 by means of the step clutch 42, thereby driving or stopping, e.g., the feeding roller 33 of the MPT transport path "m". An unillustrated drive gear for rotationally driving the eccentric cam 36 is coupled to the step clutch 43. The controller 40 connects or disconnects transmission of driving force of the motors 41 to the eccentric cam 36 by means of the step clutch 43. Thus, the eccentric cam 36 is driven and stopped, thereby lifting or lowering the elevation tray 31 by way of the lift plate 35.

Specifically, upon detection of the MPT cover 30 having been opened with respect to the reclosable cover 100 through use of an unillustrated sensor, the controller 40 drives the groups of motors 41 to thus rotate the eccentric cam 36 so as to lower the lift plate 35 to the lowermost position by way of the step clutch 43. As a result, the extremity section 31*b* of the elevation tray 31 is lowered so as to depart from the outer peripheral surface 33*a* of the feeding roller 33 so that the recording paper P can be set on the elevation tray 31. When a start key in an unillustrated control section is pressed in this state, the controller 40 starts driving the groups of motors 41, and rotates the eccentric cam 36 so as to release the lift plate 35 from the pressed state, thereby lifting the elevation tray 31. Thereby, after the extremity section P1 of the set recording paper P has been pressed against the outer peripheral surface 33*a* of the feeding roller 33, the feeding roller 33 is rotationally driven by way of the step clutch 42.

Thereby, when the feeding roller 33 picks up the recording paper P on the elevation tray 31 to thus feed the paper to the MPT transport path "m," the limitation pad 31*c* located in the center of the extremity section 31*b* of the elevation tray 31 is brought into pressed contact with the lowermost sheet of recording paper P, thereby preventing from sequential feeding of the recording paper P from the lowermost sheet thereof. Even when a plurality of sheets of recording paper P are delivered between the feeding roller 33 and the retard roller 34, the recording paper P other than the top sheet thereof is stopped by the outer peripheral surface 34*a* of the retard roller 34, and only the topmost sheet of recording paper P can be separately fed one at a time.

Figure 7:
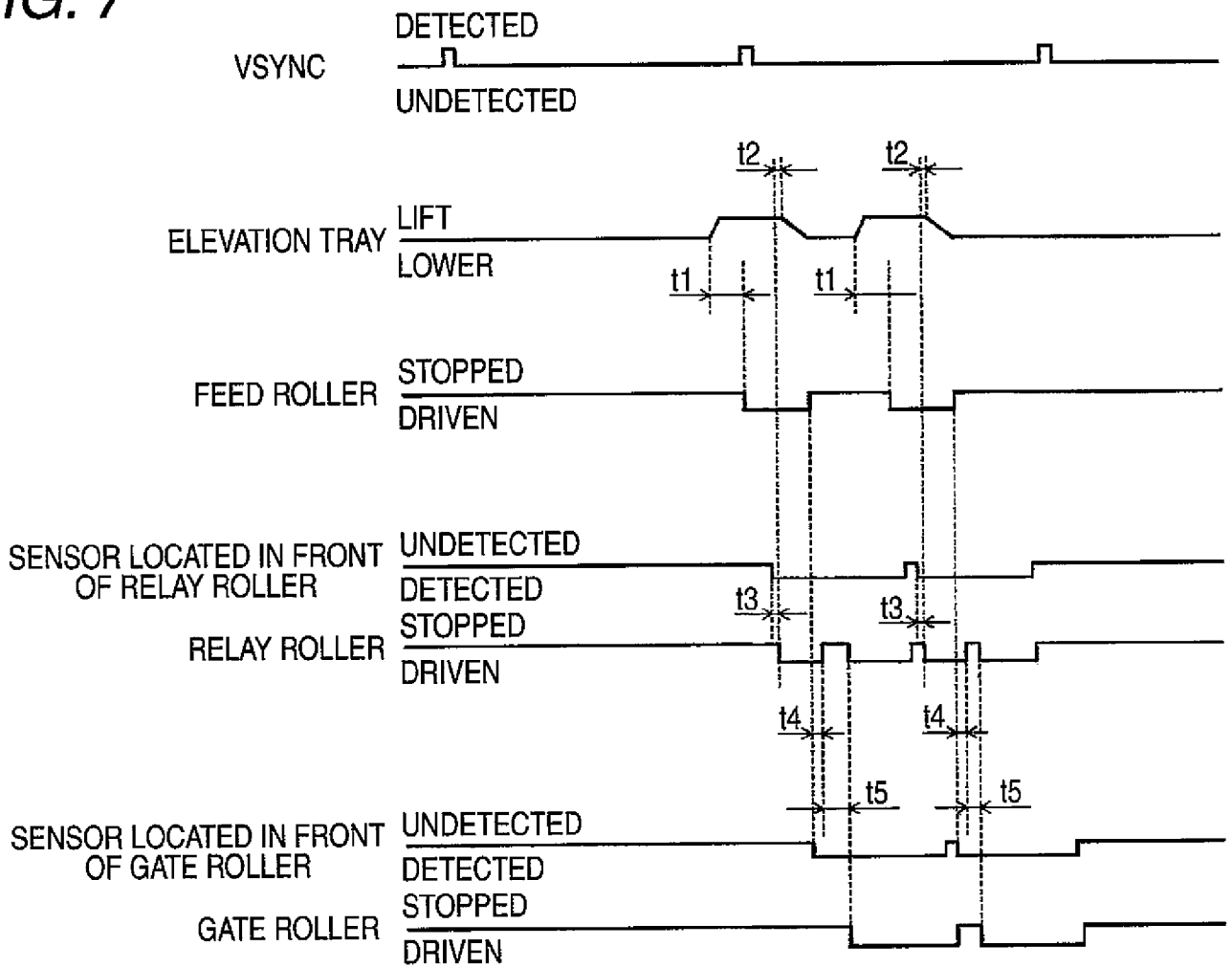
FIG. 7 is a timing chart describing operation for controlling feeding of recording paper from the multipurpose tray of the exterior cover.

At this time, as shown in FIG. 7, the controller 40 starts driving operation of the image recording device and that of the paper transport device, both of which are provided in the image-forming apparatus main body 10. The recording paper P on the elevation tray 31 is separately fed in synchronism with recording and formation (transfer) of an image while a sensor signal for detecting one rotation of the intermediate transfer belt 15 is taken as a reference signal, thereby feeding paper to the position where an image is recorded and formed by the intermediate transfer belt 15 and the transfer roller 16. Lifting and lowering of the elevation tray 31 and rotation of the feeding roller 33 are controlled as follows in accordance with the amount of recording paper P fed to the MPT transport path "m" continual to the transport path "f" for the pair of relay transport rollers 24 and the pair of gate rollers 25.

In detail, the eccentric cam 36 is rotated to lift the elevation tray 31 (the lift plate 35) at a timing which is delayed, only a preset period, from the timing of a sensor signal (Vsync) for detecting one rotation of the intermediate transfer belt 15 before recording and formation of an image. Thereby, the extremity section P1 of the recording paper P set on the load surface is brought into pressed contact with the outer peripheral surface 33*a* of the feeding roller 33, thereby preparing feeding of the recording paper P. Subsequently, rotational driving of the feeding roller 33 is started at a timing delayed by only a sufficient time t1 from when lifting of the elevation tray 31 is started until when lifting operation is completed. Thus, the recording paper P on the elevation tray 31 is separately fed one at a time in conjunction with the limitation pad 31*c* of the extremity section 31*b* and the retard roller 34, thereby causing the recording paper P to travel from the MPT transport path "m" to the inside of the ordinary transport path "f."

When an unillustrated paper detection sensor provided in front of the pair of relay transport rollers 24 has detected the recording paper P fed over the transport path "f," rotational driving of the pair of relay transport rollers 24 is commenced, thereby nipping and transporting the recording paper P traveling over the transport path "f." At this time, the eccentric cam 36 is further rotated to thus lower the elevation tray 31 at a timing delayed from the timing at which the paper detection sensor provided in front of the pair of relay transport rollers 24 have detected the recording paper P, by a time t2 sufficient for nipping and transporting the recording paper P. The extremity P1 of unfed recording paper P set on the load surface is separated from the outer peripheral surface 33*a* of the feeding roller 33 until commencement of separation feeding of the next sheet of recording paper P. Thereby, the bundle of sheets of recording paper P awaiting on the elevation tray 31 until the pieces of paper are fed enter a standby condition while being temporarily separated from the feeding roller 33 and the retard roller 34. Reference symbol "t3" shown in FIG. 7 denotes a time lag from when the paper sensor for the pair of relay transport rollers 24 has detected the recording paper P until when the pair of relay transport rollers 24 are started to be rotationally driven. Variations exist in the time, in FIG. 7, at which the elevation tray 31 is lifted or lowered are attributable to the shape of the outer peripheral surface of the eccentric cam 36 that slidably contacts the lift plate 35; that is, a difference in rotational angle required for lifting or lowering the elevation tray 31.

When the unillustrated paper detection sensor provided in front of the pair of gate rollers 25 has detected the recording paper P nipped and transported by the pair of relay transport rollers 24, nipping and transporting of the recording paper P is left to the pair of relay transport rollers 24, and rotational driving of the feeding roller 33 is stopped until separation feeding of the next sheet of recording paper P is started, and the feeding roller 33 is driven (driven so as to follow) in conjunction with the recording paper P to be nipped and transported. Specifically, the feeding roller 33 stops driving operation before the trailing end section P2 of the recording paper P passes through the nipping position between the feeding roller 33 and the retard roller 34. When active rotation of the feeding roller 33 has stopped, the load for directly driving the retard roller 34 remaining in pressed contact with the outer peripheral surface 33*a* of the feeding roller 33 is released. As a result, the torque limiter 34*c* attempts to its natural state with respect to the stationary shaft 34*b*. Hence, the retard roller 34 slightly rotates reversely in a direction opposite to the feeding direction of the recording paper P (the clockwise direction in FIGS. 3 and 4). Therefore, in relation to the bundle of sheets of recording paper P awaiting on the elevation tray 31 until they are fed, force of backward movement stemming from reverse rotation of the retard roller 34 is not exerted on and accumulated in the bundle of sheets of paper, even in the case of a structure where the feeding roller 33 and the retard roller 34 remain in pressed contact with each other. Backward movement of the extremity section P1 of the recording paper P to a position where the extremity section P1 cannot be nipped by the outer peripheral surface 33*a* of the feeding roller 33 does not arise.

The pair of relay transport rollers 24 and the pair of gate rollers 25, which are located in positions subsequent to the position where the recording paper P has been detected by the paper detection sensor located in front of the pair of gate rollers 25, are not distinguished from each other by means of the transport path. The recording paper P having passed is nipped and transported to the image recording-and-forming position. The pair of relay transport rollers 24 continually nip and transport the recording paper P for only a period of time t4 during which the extremity of the recording paper P is sufficiently brought into collision with the nipping section of the pair of gate rollers 25, thereby correcting skewing (oblique traveling) of the recording paper P and temporarily stopping the recording paper P.

Subsequently, after having awaited for only a period of time t5 required for synchronization with the timing at which a toner image is transferred to the intermediate belt 15, the pair of relay transport rollers 24 and the pair of gate rollers 25 start rotational driving such that the recording paper P is fed to the image-recording-and-forming position between the intermediate transfer belt 15 and the transfer roller 16. Operation for nipping and transporting the recording paper to the image-recording-and-forming position is continued, and the trailing end section P2 of the recording paper P is detected to have passed through the nipping position. Then, the rotational driving of the pair of relay transport rollers 24 and the rotational driving of the pair of gate rollers 25 are stopped.

In a case where the recording paper P to be subjected to operation for recording and forming an image is in numbers, analogous control operation for separately feeding the next sheet of recording paper P from the elevation tray 31 is started before the trailing end section P2 of the recording paper P is detected to have passed through the nipping position between the pair of relay transport rollers 24 and the pair of gate rollers 25 by means of the paper detection sensor located in front of the rollers 24, 25. FIG. 7 illustrates a case where images are formed on two sheets of recording paper P.

As mentioned above, in the present embodiment, the elevation tray 31 is lowered at the timing at which the feeding roller 33 is stopped while the retard roller 34 remains in pressed contact with the feeding roller 33, thereby releasing the feeding roller 31 from the pressed contact with the extremity section P1 of the awaiting recording paper P. Even when the retard roller 34 has slightly reversely rotated in reaction to stoppage of the feeding roller 33, backward movement of the recording paper P on the elevation tray 31 can be avoided. Moreover, backward movement of the recording paper P to such an extent that the recording paper P cannot be nipped by the outer peripheral surface 33*a* of the feeding roller 33, which would otherwise be caused by accumulation of backward movement, can be prevented. Therefore, the recording paper P, on which an image is to be formed next time, can be brought into pressed contact with the outer peripheral surface 33*a* of the feeding roller 33 without fail and separately fed with high reliability by means of the limitation pad 31*c* on the extremity section 31*b* of the elevation tray 31 and the retard roller 34, so that the recording paper can be fed to a position where an image is recorded and formed.

In another mode of the above-described present embodiment, the elevation tray 31 is lowered and the feeding roller 33 is maintained in a stationary state until when separate feeding of the next sheet of recording paper P during the course of the recording paper P being transported by the pair of relay transport rollers 24 and the pair of gate rollers 25. For instance, in a case where rotational driving of the feeding roller 33 is continued and temporarily stopped in conjunction with the pair of gate rollers 25 even after the recording paper P has been passed to the pair of relay transport rollers 24, the essential requirement is to lower the elevation tray 31 immediately before stoppage of the feeding roller 33 at the same time when the feeding roller 33 is stopped. Even in this case, a similar working-effect can be yielded, and the recording paper P can be fed along with the pair of relay transport rollers 24 and the pair of gate rollers 25. However, in a case where the recording paper P is not a type which requires a plurality of pieces of feeding load, lifting and lowering the elevation tray 31 are troublesome. Hence, drive control, such as that mentioned in the above embodiment, is preferable.

Second Embodiment

A paper feeding method and a paper feeder, both of which pertain to the present invention, will be described hereinbelow by reference to the drawings.

Figure 8:
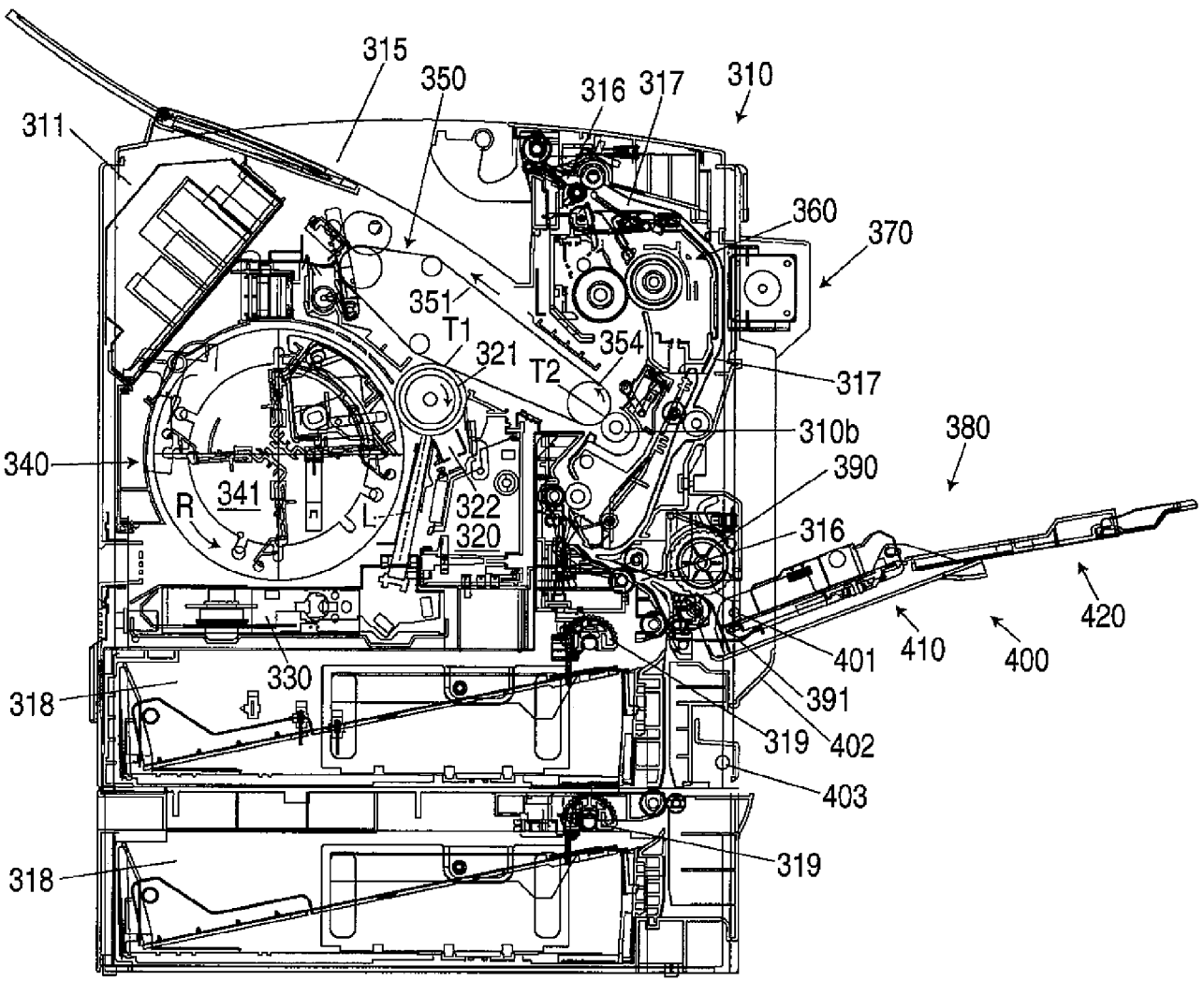
FIG. 8 is a schematic front view showing an example internal structure of a color image-forming apparatus using an embodiment of a paper feeding method and that of a paper feeder, both of which pertain to the present invention.

FIG. 8 s a schematic front view showing an example internal structure of a color image-forming apparatus using an embodiment of the paper feeding method and that of the paper feeder, both of which pertain to the present invention.

The image-forming apparatus is a color image-forming apparatus capable of longitudinally feeding A4-size paper (including letter-size paper) and forming a full-color image on both surfaces of the paper. The image-forming apparatus is equipped with a case 310; an image carrier unit 320 housed in the case 310; an exposure unit 330 serving as exposure means; a developer unit (development device) 340 serving as developing means; an intermediate transfer member unit 350; and a fusing unit (fuser) 360 serving as fusing means.

The case 310 is provided with an unillustrated frame of the apparatus main body, and the respective units are mounted on this frame.

The image carrier unit 320 has a photosensitive member 321 having a photosensitive layer on a circumferential surface thereof, and a corona charger (scorotoron charger) 322 serving as electrifying means for uniformly electrifying the outer circumferential surface of the photosensitive member 321. The outer circumferential surface of the photosensitive member 321 having been uniformly charged by the corona charger 322 is selectively exposed to a laser beam L output from the exposure unit 330, thereby forming an electrostatic latent image. Toner serving as a developing agent is imparted to the electrostatic latent image by means of the developer unit 340, thereby forming a visible image (toner image). This toner image is transferred to an intermediate transfer belt 351 of the intermediate transfer member unit 350 by a primary transfer section T1 through primary transfer operation. Moreover, a secondary transfer section T2 transfers the toner image onto paper, which is an object of transfer, through secondary transfer operation.

Provided in the case 310 are a transport path 316 for transporting the paper, on one side of which an image is formed by the secondary transfer section T2, toward a paper output section (paper output tray section) 315 on the upper surface of the case 310, and a return path 317 which switches back the paper transported from the transport path 316 toward the paper output section 315, to thus return the paper toward the secondary transfer section T2 in order to form an image on the other surface.

Reference numeral 370 designates a double-sided unit removably attached to the apparatus main body, and the return path 317 is formed as a result of attachment of the double-sided unit 370.

Paper feeding cassettes 318 for retaining a plurality of sheets of paper in a stacked manner are provided in two layers in the lower portion of the case 310. Each of the paper feeding cassettes 318 is provided with a paper feeding roller 319 for feeding paper one at a time toward the secondary transfer section T2.

A multipurpose tray 400 constituting a paper feeder 380 of the present invention is provided below the double-sided unit 370. The apparatus main body is provided with a paper feeding roller 390 which feeds, one at a time, the paper set in the multipurpose tray 400.

This paper feeder 380 will be described in detail later.

The developer unit 340 is a rotary developer unit (a rotary development device), and a plurality of developer cartridges (not shown) housing toner are removably attached to a rotary member main body 341. As a result of the rotary member main body 341 rotating at a pitch of 90 degrees in the direction of arrow R, the development rollers (not shown) provided with the respective developer cartridges are selectively brought into contact with the photosensitive member 321, thereby enabling selective development of the surface of the photosensitive member 321.

The exposure unit 330 radiates the laser beam L toward the photosensitive member 321.

The intermediate transfer member unit 350 is equipped with an unillustrated unit frame; a drive roller 354 rotatably supported by this frame; and the intermediate transfer belt 351 tensilely passed across a plurality of follower rollers. The intermediate transfer belt 351 is driven in a circulatory manner in the direction of an illustrated arrow. The primary transfer section T1 is formed in the section where the photosensitive member 321 and the intermediate transfer belt 351 come into contact with each other. The secondary transfer section T2 is formed in a nipping section existing between the drive roller and a secondary transfer roller 310*b* provided in the main body.

The secondary transfer roller 310*b* can come into contact with or detach from the drive roller 354 (in turn from the intermediate transfer belt 351). Upon coming into contact with the drive roller 354, the secondary transfer roller 310*b* forms the secondary transfer section T2.

Therefore, when a color image is formed, toner images of a plurality of colors are superimposed one on top of the other on the intermediate transfer belt 351 while the secondary transfer roller 310*b* remains separated from the intermediate transfer belt 351, to thus form a color image. Subsequently, the secondary transfer roller 310*b* comes into contact with the intermediate transfer belt 351, whereupon the paper is supplied to the contact section (i.e., the secondary transfer section T2). As a result, the color image (toner image) is transferred to the paper from the intermediate transfer belt 351 (through secondary transfer operation).

The paper, on which the toner image has been transferred, passes through the fusing unit 360, whereby the toner image is fixedly fused. The paper is then discharged toward the paper output tray section 315.

Feeding of paper to the image-forming section is performed selectively by any one of the above-described two paper feeding cassettes 318 and the multipurpose tray 400.

In general, plain paper, or the like, is steadily set in the paper feeding cassettes 318. However, various types of paper are set in the multipurpose tray 400, as required. Specifically, plain paper (including thin paper), cardboard (a post card, an envelope, or an OHP sheet other than the cardboard), or another recording material is set in the multipurpose tray 400, in accordance with a user's requirement.

Figure 9:
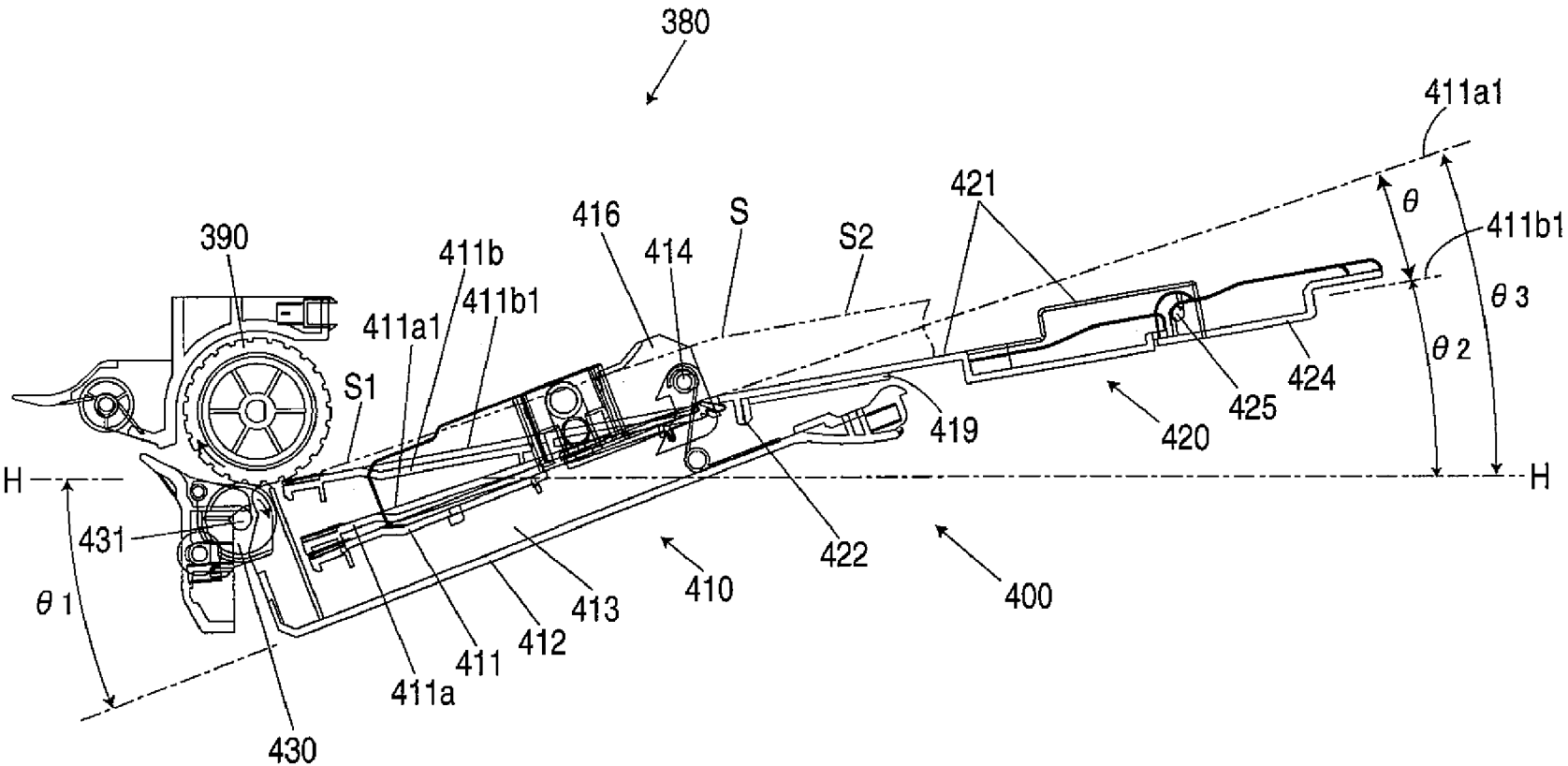
FIG. 9 is an enlarged fragmentary view of FIG. 8.
Figure 10:
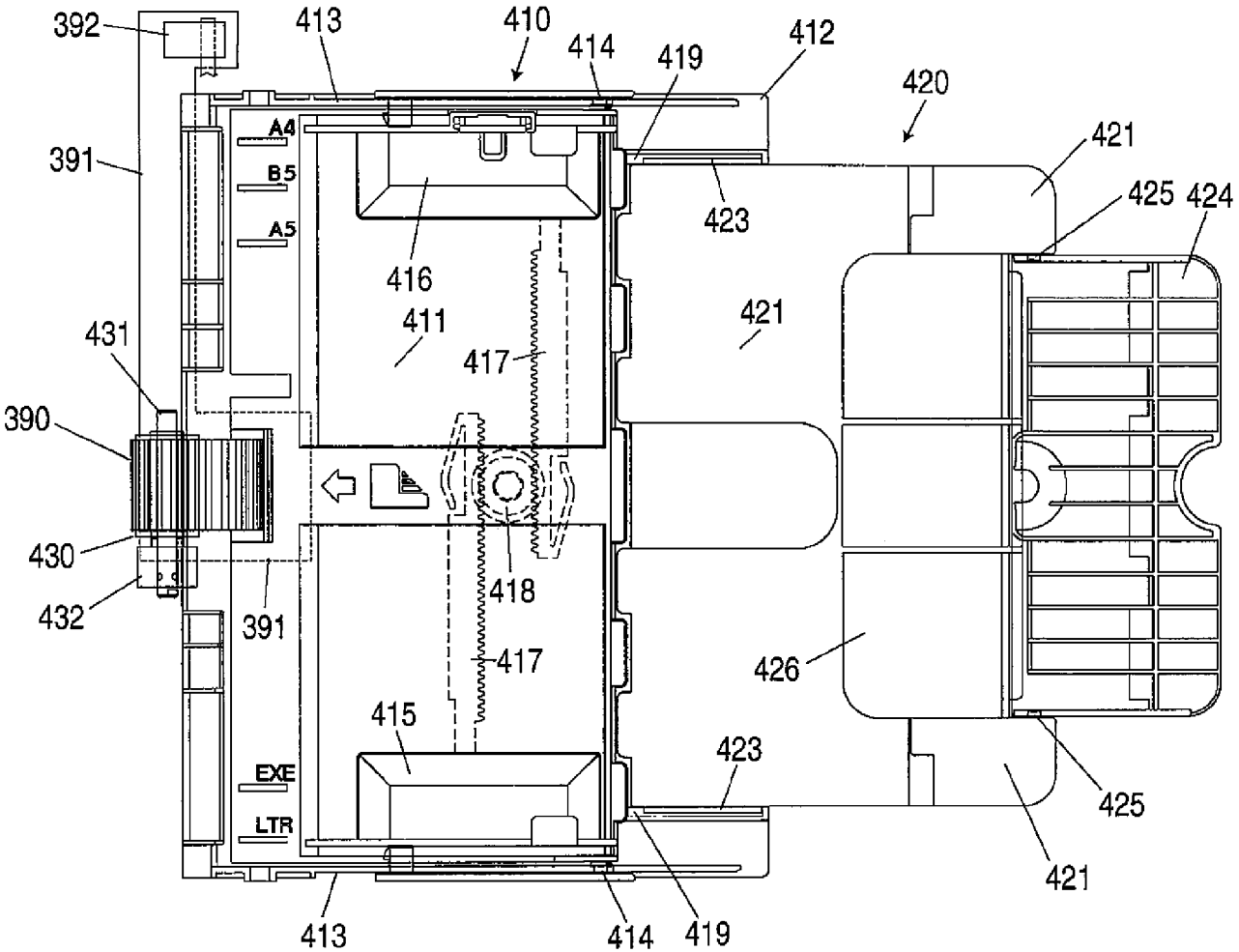
FIG. 10 is a plan view of the principle section shown in FIG. 9.

FIG. 9 is an enlarged fragmentary view of FIG. 8 and corresponds to a front view of a paper feeder 380. FIG. 10 is a plan view of the principal section of the paper feeder 380.

As shown in these drawings (chiefly in FIG. 9), the paper feeder 380 has a paper feeding roller 390 which comes into contact with the topmost sheet of paper of stacked paper S to thus feed the topmost sheet of paper; a lift plate 411 which supports a front section S1 of paper to be fed by the paper feeding roller 390 and presses a front portion S1 of paper against the paper feed roller 390; a first tray 410 which is inclined with respect to the horizontal plane H (at an angle of inclination θ1); and a second tray 420 which is coupled to a rear portion of the first tray 410, supports a rear section S2 of the paper S, and makes a smaller angle of inclination $\theta_2$ with respect to the horizontal plane H than that made by the first tray 410.

A paper support face 421 of the second tray 420 is configured to fall within a range of angle θ made between a paper support face 411*a* 1 of the lift plate acquired at a position 411*a* where the lift plate 411 is lifted when a maximum number of sheets of paper that can be stacked on the first tray 410 are stacked and a paper support face 411*b* 1 of the lift plate 411 acquired at a position 411*b* where the lift plate 411 is lifted when one sheet of paper is supported by the first tray 410.

Reference numeral 430 designates a retard roller with a torque limiter which comes into contact with the paper feed roller 390, and the topmost sheet of paper and the sheet of paper directly below the topmost sheet of paper are separated from each other by the retard roller 430.

The retard roller 430 is attached, in a rotatable manner, to a fixed shaft 431 by way of a torque limiter 432 (see FIG. 10), and is forced at all times in the direction of an arrow (in the same direction as that of the paper feeding roller 390; that is, in a clockwise direction in FIG. 9) by means of a spring fitted in the torque limiter 432.

Consequently, in a case where, when the sheet of paper directly below the topmost sheet of paper and subsequent sheets of paper are about to be fed during the course of the topmost sheet of paper being fed by the paper feeding roller 390, rotation of the retard roller 430 is hindered by load torque stemming from the torque limiter 432, thereby hindering feeding of the sheet of paper directly below the topmost sheet of paper. Feeding of the sheet of paper directly below the topmost sheet of paper is hindered, and only the topmost sheet of paper is nipped between the paper feeding roller 390 and the retard roller 430. When the upper limit torque of the torque limiter 432 is exceeded, the retard roller 430 is driven by the paper feeding roller 390 by way of the topmost sheet of paper, whereupon only the topmost sheet of paper is fed.

As shown in FIG. 8, the multipurpose tray 400 (which is, in turn, the first tray 410) is reclosably attached to a side cover 402 of the main body case 310 of the image-forming apparatus 310 by means of a shaft 401. The side cover 402 is configured so as to be able to open/close with respect to the image-forming apparatus main body by means of the shaft 403. FIG. 8 shows a state where the side cover 402 is closed; and where the multipurpose tray 400 is opened so as to be usable.

As shown in FIGS. 9 and 10, the first tray 410 comprises an essentially-box-shaped tray main body 412, and the lift plate 411 that is attached to both side plates 413 of the tray main body 412 in a pivotable manner by means of a shaft 414.

As shown in FIG. 8, the image-forming apparatus main body is provided with a push plate 391 used for pushing the lift plate 411. The base section of the push plate 391 is attached to the image-forming apparatus main body, and the extremity of the push plate 391 moves into a position below the lift plate 411.

The push plate 391 is provided with an unillustrated forcing member (e.g., a tension spring) which forces the push plate 391 in the pushing direction at all times. When the multipurpose tray 400 (which, in turn, is the first tray 410) is opened as shown in FIG. 8, the extremity of the push plate 391 forces the lift plate 411 upward at all times. Thereby, the extremity of paper is pressed toward the paper feeding roller 390, but the image-forming apparatus main body is provided with a cam (e.g., an eccentric cam) 392 (see FIG. 10) forming a lift plate lifting-and-lowering mechanism for lifting or lowering the lift plate 411. When the push plate 391 is lowered by the cam 392, pressing of paper against the paper feeding roller 390 by the lift plate 411 is released, whereby the lift plate 411 is lowered.

As shown in FIG. 10, side guides 415, 416, which can slide in a widthwise direction thereof (i.e., the vertical direction in FIG. 10), are attached to the lift plate 411. The side guides are for guiding side edges of paper to be fed. A rack 417 is provided integrally on each of the bottoms of the side guides 415, 416. The racks 417 mesh with a gear 418 provided on the lift plate 411. Consequently, when either the side guide 415 or 416 is slid, the other side guide is also slid. The center of paper coincides with the position of the paper feeding roller 390.

The second tray 420 is configured so that it can be housed in the first tray 410 (a position below the lift plate 411) and withdrawn.

As shown in FIG. 9, when the second tray 420 is withdrawn from the first tray 410, projections 422 provided at both ends of a lower portion of the extremity of the second tray 420 come into contact with extremities of ribs 419 provided on interior surfaces of the side plates 413 of the first tray 410, thereby preventing slipping-out of the second tray 120. Moreover, as shown in FIG. 10, ribs 423 provided on both side sections of the second tray 420 come into contact with the ribs 419 provided on the first tray 410, thereby defining the angle of inclination of the second tray 420.

As mentioned above, the paper support face 421 of the second tray 420 falls within the range of angle θ made between the paper support face 411*a*1 of the lift plate 411 acquired at the position 411*a* where the lift plate 411, which carries a maximum number of sheets of paper that can be stacked on the first tray 410, is lifted and the paper support face 411*b*1 of the lift plate 411 acquired at the position 411*b* when one sheet of paper is supported by the first tray 410.

As shown in FIGS. 9 and 10, an auxiliary tray 424 is coupled to the rear portion of the second tray 420 in a pivotable manner by means of a shaft 425. The auxiliary tray 424 is rotatable through 180 degrees about the shaft 425. FIGS. 9 and 10 show the opened status of the auxiliary tray 424. However, the auxiliary tray 424 can be rotated through 180 degrees and housed in a recessed section 426 in the upper surface of the second tray 420 (see FIG. 10). The auxiliary tray 424 is opened for use when legal-sized paper is to be supported.

The paper feeding method of the present embodiment is a paper feeding method to be performed by the above-described paper feeder 380. According to this method, when the paper S is plain paper, paper is fed while the lift plate 411 is held in a pressed state. When the paper S is cardboard, the lift plate 111 is lifted and lowered every time one sheet of cardboard is fed.

Lifting and lowering of the lift plate 411 performed when the paper is cardboard is effected such that the lift plate 411 is lowered after feeding of one sheet of cardboard and before the trailing edge of the cardboard passes through the contact section between the paper feeding roller 390 and the retard roller 430 and such that the lift plate 411 is lifted before initiation of feeding of the sheet of cardboard located directly under the topmost sheet of cardboard.

The paper feeder 380 has a plain paper mode and a cardboard mode, as well as having a controller for selecting either the plain paper mode or the cardboard mode. In the plain paper mode, when the paper S is plain paper, paper is fed while the lift plate 311 is held in a pressed state by means of the lift plate lifting-and-lowering mechanism 392. In the cardboard mode, when the paper S is cardboard, the lift plate lifting-and-lowering mechanism 392 feeds paper by lowering or lifting the lift plate 411 every time one sheet of cardboard is fed.

Figure 11:
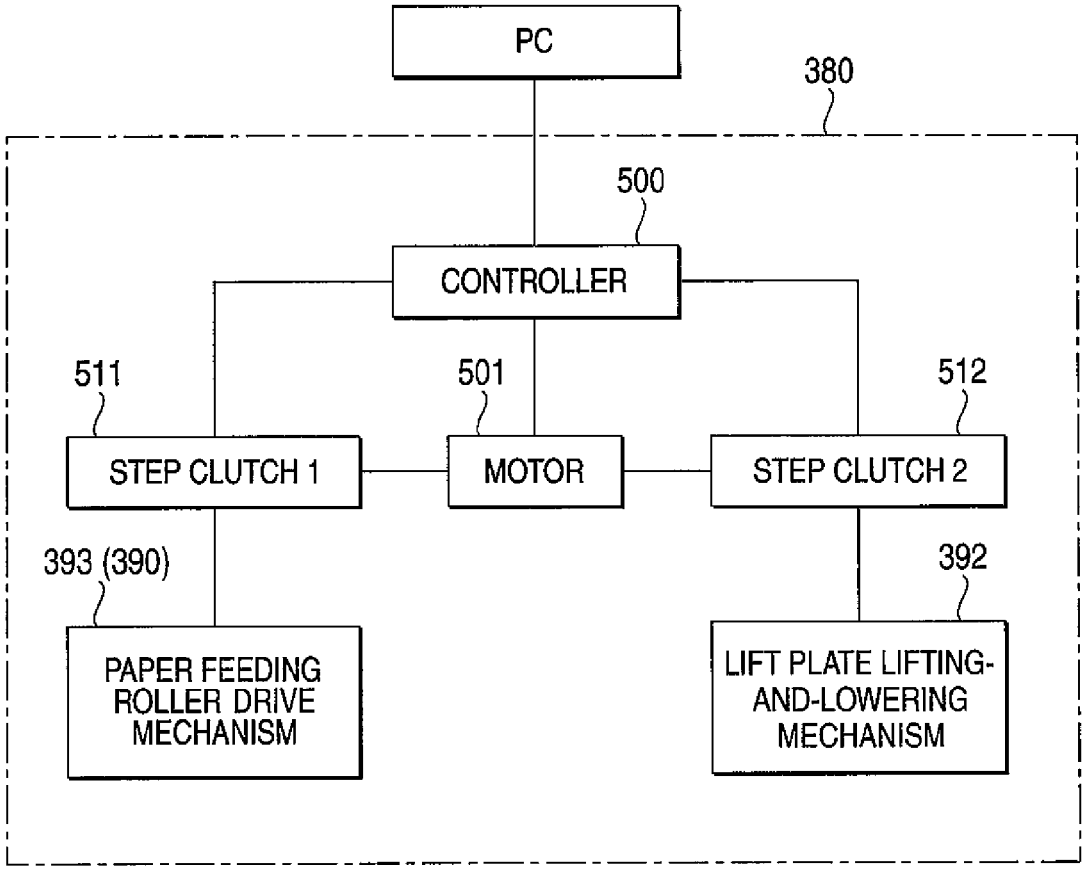
FIG. 11 is a block diagram of a paper feeder.
Figure 12:
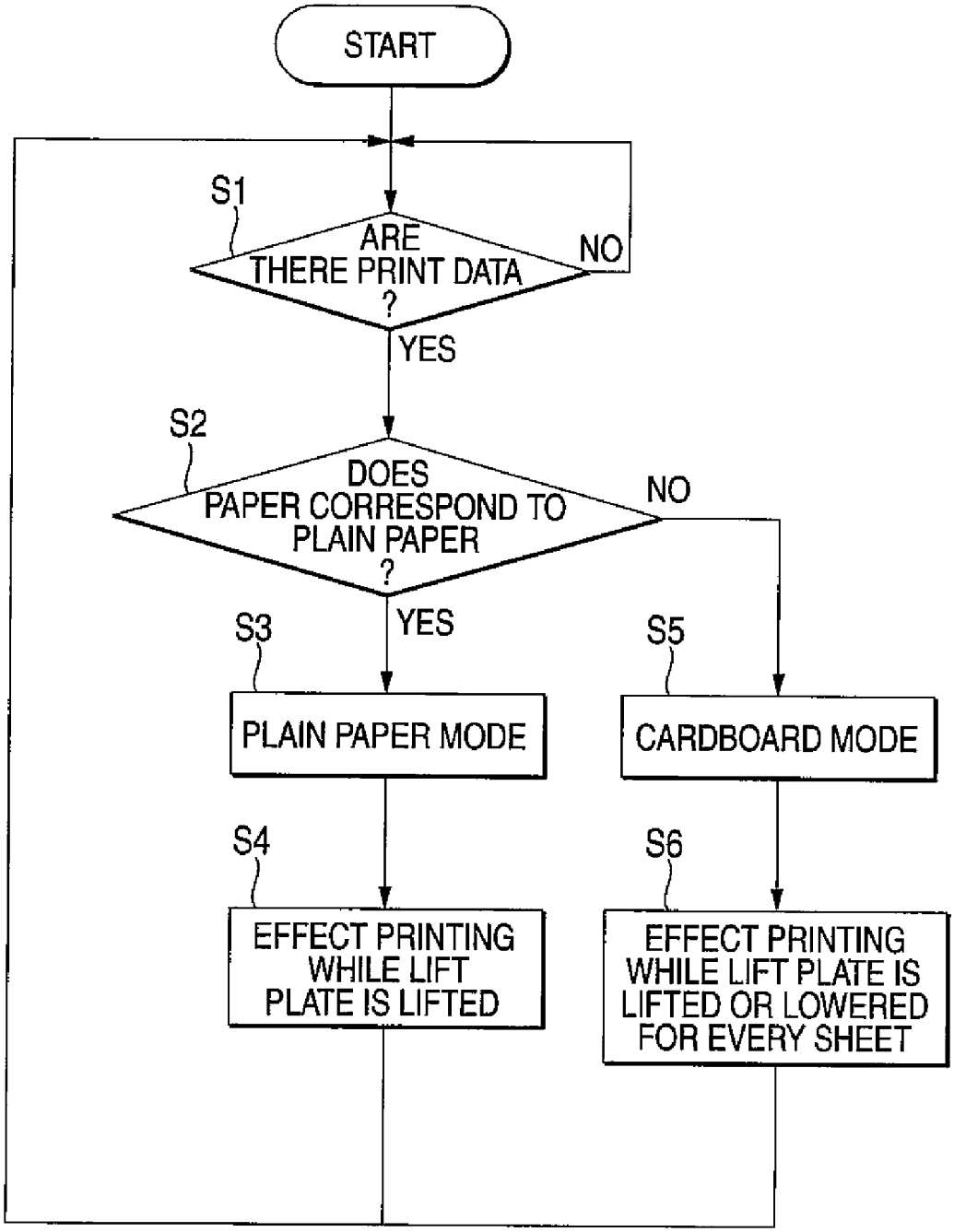
FIG. 12 is a flowchart showing a paper feeding method.

FIG. 11 is a block diagram of the paper feeder 380, and FIG. 12 is a flowchart showing the paper feeding method.

As shown in FIG. 11, the paper feeder 380 has a controller 500 for controlling the overall image-forming apparatus; a motor 501 whose driving operation is controlled by the controller 500; a first step clutch 511 which is interposed between the motor 501 and the drive mechanism 393 of the paper feeding roller 390 and whose activation/deactivation is controlled by the controller 500; a second step clutch 512 which is interposed between the motor 501 and the lift plate lifting-and-lowering mechanism (cam) 392 and whose activation and deactivation are controlled by the controller 500; the drive mechanism 393 of the paper feeding roller 390; and the lift plate lifting-and-lowering mechanism (cam) 392.

The plain paper mode and the cardboard mode are stored in memory of the controller 500.

The controller 500 is connected to a personal computer P•C to which the image-forming apparatus of the present embodiment is connected.

In this embodiment, when "plain paper" or "cardboard" has been selected as the kind of paper used by the user on a setting screen of the printer driver installed in the personal computer P•C, the controller 500 selects either the ordinary paper mode or the cardboard mode in accordance with the result of selection, as shown in FIG. 12, and activates the paper feeder 380 in the thus-selected mode. Selection operation can also be performed by user's operation on the control panel provided in the image-forming apparatus.

Operation of the paper feeder 380 will be described by reference primarily to FIG. 12.

(i) Upon receipt of a print command signal (which is, in turn, print data) sent from the personal computer P•C, the controller 500 determines whether the print data correspond to data for plain paper or data for cardboard, in step S2 by way of step S1. As mentioned previously, this determination is rendered by the user by way of the personal computer P•C in response to selection of "plain paper" or "cardboard" as the kind of paper.

Now, when no print data are input, the controller 500 enters a standby condition for awaiting input of print data.

(ii) When having determined, in step S2, that the image data correspond to data for plain paper, the controller 500 selects the plain paper mode in step S3. In step S4, the controller 500 activates the motor 501 and the second step dutch 512 (see FIG. 11); releases the pushing force on the push plate 391 imposed by the cam 392 (see FIG. 10), to thus push the paper S against the paper feeding roller 390 by means of the lift plate 411; activates the first step clutch 511 while maintaining the pressing state to rotate the paper feeding roller 390; and feeds paper to the image-forming section of the image-forming apparatus until printing operation (formation of an image) specified by the print data is fully completed.

Consequently, when the print data run to a plurality of sheets of paper, a plurality of sheets of plain paper are continuously fed while the lift plate 411 is held in a pressed state.

After completion of feeding of paper for printing all of sets of print data, the controller 500 deactivates the first step clutch 511, and activates the second step clutch 512, thereby rotating the cam 392 to thus push the push plate 391, thereby lowering the lift plate 411. Thus, the controller 500 enters a standby condition.

(iii) When having determined the image data as data for cardboard in step S2, the controller 500 repeatedly performs the following operations until printing specified by the print data (i.e., image forming operation) is fully completed; namely, operations for: selecting the cardboard mode in step S5; activating the motor 501 in step S6; alternately activating and deactivating the second step clutch 512 and the first step clutch 511; releasing the pushing force on the push plate 391 imposed by the cam 392 (see FIG. 10) to cause the lift plate 411 to push the paper S against the paper feeding roller 390 and to rotate the paper feeding roller 390, thereby feeding paper; and lowering the lift plate 411 by pushing the push plate 391 by means of the cam 392 before the trailing edge of the paper S passes through the contact section (i.e., the nipping section) between the paper feeding roller 390 and the retard roller 430.

Therefore, when the print data run to a plurality of sheets of paper and when paper is cardboard, paper is fed by lifting or lowering the lift plate 411 by means of the cam 392 every time one sheet of cardboard is fed.

After feeding operation for printing all sets of print data has been completed, the controller 500 deactivates the first step clutch 511; activates the second step clutch 512 to thus rotate the cam 392; lowers the lift plate 411 by lowering the push plate 391 downward; and then enters a standby condition.

The paper feeding method of the present embodiment is for use with the paper feeder having the paper feeding roller 390 which comes into contact with the topmost sheet of paper among the stacked sheets of paper to thus feed the topmost sheet of paper; the retard roller 430 which comes into contact with the paper feeding roller 390 to thereby separate the topmost sheet of paper from the sheet of paper directly thereunder; and the lift plate 411 which supports paper to be fed by the paper feeding roller 390 and presses a front portion of the paper against the paper feeding roller 390. This method is to feed paper while the lift plate 411 remains pressed when paper corresponds to plain paper and to lift or lower the lift plate 411 every time one sheet of cardboard is fed when paper corresponds to cardboard.

Moreover, a paper feeder of the present embodiment includes the paper feeding roller 390 which comes into contact with a topmost sheet of paper among stacked sheets of paper to thereby feed the topmost sheet of paper; the retard roller 430 which comes into contact with the paper feeding roller 390 to separate the topmost sheet of paper from the sheet of paper directly thereunder; the lift plate 411 which supports paper to be fed by the paper feeding roller 390 and presses a front portion of paper against the paper feed roller 390; the lift plate lifting-and-lowering mechanism 392 for lifting or lowering the lift plate 411; and the controller 400 which selects either a plain paper mode, where paper is fed by the lift plate lifting-and-lowering mechanism 392 while the lift plate 411 remains pressed when the paper is plain paper, or a cardboard mode, where paper is fed by lifting or lowering the lift plate 411 every time one sheet of cardboard is fed by means of the lift plate lifting-and-lowering mechanism 392 when the paper is cardboard. According to this paper feeding method or the paper feeder 380, the following working-effect can be achieved.

Specifically, when paper to be fed corresponds to plain paper, paper is fed while the lift plate 411 remains in a pressed state. Hence, when the topmost sheet of paper is fed, the lift plate 411 is brought into a pressed state (a lifted state), whereupon paper is supported.

Accordingly, tremble vibration, which would otherwise arise in the nipping section between the paper feeding roller 390 and the retard roller 430, is prevented, and occurrence of chattering sound (noise) is prevented.

When paper to be fed corresponds to plain paper, paper is fed while the lift plate 411 remains in a pressed state. There is no necessity for lifting or lowering the lift plate 411 every time one sheet of paper is fed, and hence a plurality of sheets of paper can be efficiently, continuously fed.

Consequently, forming of images on a plurality of sheets of paper can be speeded up.

Meanwhile, when paper to be fed corresponds to cardboard, the lift plate 411 is lifted or lowered every time one sheet of cardboard is fed. The lift plate 411 remains lowered when the trailing edge of paper passes through the contact section between the paper feeding roller 390 and the retard roller 430. Backward movement of the next sheet of paper and subsequent sheets of paper, which would otherwise be caused by reaction of the torque limiter 432, is prevented.

Therefore, overlapping transfer of paper and transfer failure of paper, which would otherwise arise when paper is cardboard, becomes less likely to arise.

As mentioned above, according to the second embodiment, sheets of cardboard can be fed one at a time without fail simultaneously with feeding of plain paper without causing chattering sound.

The paper feeder 380 of the present embodiment includes the paper feeding roller 390 which comes into contact with a topmost sheet of paper among stacked sheets of paper S to thereby feed the topmost sheet of paper; the lift plate 411 which supports the front section S1 of paper to be fed by the paper feeding roller 390 and presses the front portion S1 of paper against the paper feed roller 390; a first tray 410 which is tilted (an angle of inclination is denoted by θ1) with respect to the horizontal plane H; and a second tray 420 which is coupled to a rear portion of the first tray 410, supports a rear portion S2 of the paper S, and makes a smaller tilt angle θ2 with respect to the horizontal plane H than that made by the first tray 410.

Further, a paper support face 421 of the second tray 420 falls within a range of angle θ made between a paper support face 411*a* 1 of the lift plate achieved at a position 411*a* where the lift plate 411 is lifted when a maximum number of sheets of paper that can be set on the first tray 410 are stacked on the first tray and a paper support face 411*b* 1 of the lift plate 411 achieved at a position 411*b* where the lift plate 411 is lifted when one sheet of paper is supported by the first tray 410. Accordingly, the paper support face 421 of the second tray 420 achieved when the maximum number of sheets of paper that can be set on the first tray 410 are stacked on the first tray turns into a slope which makes the same angle as an angle θ3 made with respect to the horizontal plane H by the paper support face 411*a* 1 of the lift plate at the lifting position 411*a* of the lift plate 411, or turns into a slope whose angle of inclination with respect to the horizontal plane H is smaller. The unillustrated paper support face 421 forms a slope whose angle θ2 of inclination with respect to the horizontal plane H makes an angle smaller than the angle θ3.

Therefore, when the lift plate 411 has lifted the front portion S1 of paper, the paper support face 411*a* 1 of the lift plate 411 and the paper support face 421 of the second tray 420 are prevented from buckling downward into a dogleg shape. Therefore, even when the stacked sheets of paper S correspond to cardboard, both ends are not supported, whereby transfer failure becomes unlikely to arise.

Figure 13:
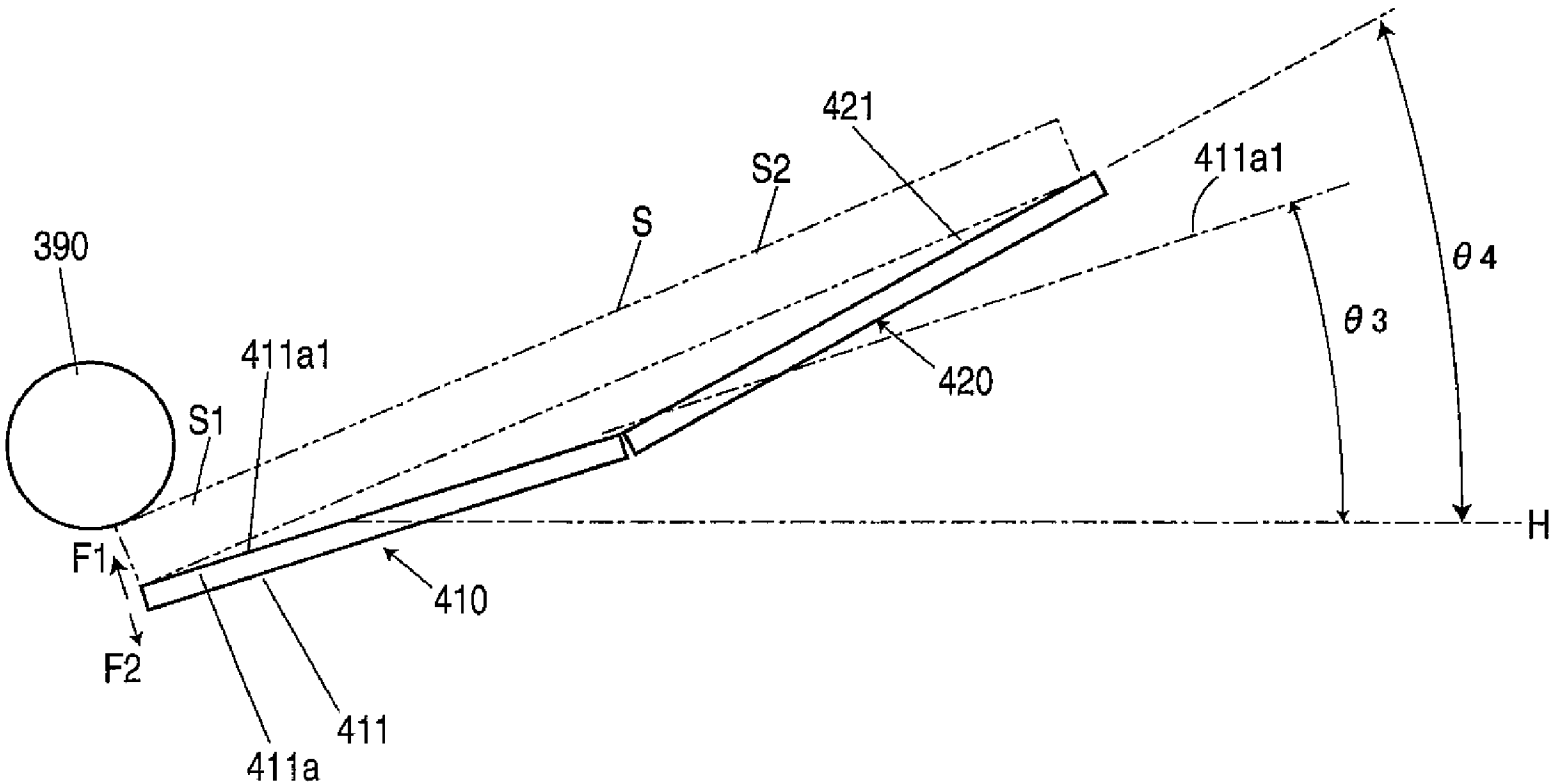
FIG. 13 is a descriptive view of operation of the invention.

FIG. 13 is a diagram for describing the above-described working-effect.

As shown in FIG. 13, under the assumption that the paper support face 421 of the second tray 420 achieved when the maximum number of sheets of paper that can be set on the first tray 410 are stacked on the first tray 410 turns into a slope which makes an angle θ4 larger than the angle θ3 made by the paper support face 411*a* 1 of the lift plate with respect to the horizontal plane H at the lifting position 411*a* of the lift plate 411, the paper support face 411*a* 1 of the lift plate 411 and the paper support face 421 of the second tray 420 are buckled downward into a dogleg shape when the lift plate 411 lifts the paper front portion S1. When the stacked sheets of paper S correspond to cardboard, both ends of the sheets of paper are supported as illustrated.

Therefore, force F2—which cancels the lift force F1 (pressing force against the paper feeding roller) exerted by the lift plate 411—becomes larger, transport failure is likely to arise.

As mentioned, according to the second embodiment of the present invention, the paper support face 421 of the second tray 420 achieved when the maximum number of sheets of paper that can be set on the first tray 410 are stacked on the first tray turns into a slope which makes the same angle as an angle θ3 made with respect to the horizontal plane H by the paper support face 411*a* 1 of the lift plate at the lifting position 411*a* of the lift plate 411, or turns into a slope whose angle of inclination with respect to the horizontal plane H is smaller. Therefore, when the lift plate 411 has lifted the front portion S1 of paper, the paper support face 411*a* 1 of the lift plate 411 and the paper support face 421 of the second tray 420 are prevented from buckling downward into a dogleg shape. Therefore, even when the stacked sheets of paper S correspond to cardboard, both ends are not supported, whereby transfer failure becomes unlikely to arise.

In the meantime, according to the present embodiment, when one sheet of paper is supported by the first tray 410, the paper support face 421 of the second tray 420 turns into a slope which forms the same angle as the angle θ2 made with respect to the horizontal plane H by the paper support plane 411*b* 1 of the lift plate 411*b* at the lifting position of the lift plate 411, or turns into a slope which makes a larger angle of inclination with respect to the horizontal plane H. The paper support face 421 shown in FIG. 9 forms a slope which makes an angle essentially identical with that made between the paper support face 411*b* 1 of the lift plate 411*b* and the horizontal plane H.

Therefore, in a case where a plurality of sheets of paper are set in the first and second trays 410 and 420, even when force which would cause backward movement because of reaction of the torque limiter of the retard roller 403 has been exerted on the next sheet of paper, paper becomes likely to slide over the tilt surfaces 411*b* 1 and 421 (or an upper surface of paper). Hence, overlapping transport of paper or transport failure of paper becomes less likely to arise.

Under the assumption that the paper support face 421 of the second tray 420 achieved when one sheet of paper is supported by the first tray 410 turns into a slope which makes an angle smaller than the angle θ2 made by the paper support face 411*b* 1 of the lift plate 411 with respect to the horizontal plane H at the lifting position 411*b* of the lift plate 411 an a state where the paper support face has pivoted clockwise in FIG. 9 to thus form a horizontal plane such as that achieved in the previously-described related art), the trailing edge of the paper supported by the second tray 420 becomes less likely to slide over the tray. Consequently, the entirety of paper becomes less likely to slide over the tray.

Therefore, in a case where a plurality of sheets of paper are set in the first and second trays 410 and 420, the next sheet of paper is likely to undergo backward movement stemming from reaction of the torque limiter of the retard roller 430. Consequently, overlapping transport of paper or transport failure of paper becomes likely to arise.

In contrast, according to this embodiment of the present invention, when one sheet of paper is supported by the first tray 410, the paper support face 421 of the second tray 420 turns into a slope which forms the same angle as the angle θ2 made with respect to the horizontal plane H by the paper support plane 411*b* 1 of the lift plate 411*b* at the lifting position of the lift plate 411, or turns into a slope which makes a larger angle of inclination with respect to the horizontal plane H. Therefore, in a case where a plurality of sheets of paper are set in the first and second trays 410 and 420, backward movement of the sheet of paper immediately below the topmost sheet of paper, which would otherwise be caused by reaction of the torque limiter of the retard roller 430, becomes difficult to arise. Consequently, overlapping transport of paper or transport failure of paper becomes less likely to arise.

Therefore, this paper feeder additionally yields an advantage of the ability to reliably feed a plurality of sheets of paper one at a time until the final sheet of paper.

In a case where the paper support face 421 of the second tray 420 achieved when the maximum number of sheets of paper that can be set on the first tray 410 are stacked on the first tray turns into the slope which makes the same angle as an angle θ3 made with respect to the horizontal plane H by the paper support face 411*a* 1 of the lift plate at the lifting position 411*a* of the lift plate 411, the lifting position of the lift plate 411 lifts (the lifting position shifts from the position 411*a* to the position 411*b*) as the number of sheets of paper on the first tray 410 is decreased as a result of feeding of paper. The first tray 410 and the second tray 420 become buckled into a dogleg shape which gradually recesses downwardly. Consequently, when stacked sheets of paper. S correspond to cardboard, both ends of the sheets of paper become gradually supported.

However, in the meantime, the number of stacked sheets of paper decreases. As a result, the force F2 that cancels the lifting force F1 stemming from the lift plate 411 is also decreased, and hence overlapping transfer of paper remains less likely to arise.

Although the first and second embodiments of the present invention has been described, the present invention is not limited to the above-described embodiments. Needless to say, the present invention can be carried out in various different forms within the scope of the technical concept of the present invention.

For instance, each of the above-described embodiment has provided a description by taking, as one example, a case where the present invention is applied to a location where the MPT cover 30 is opened and the loaded recording paper P is separately fed. However, the present invention is not limited to this application, but can also be applied to a case where a similar configuration is adopted for a separate-paper-feeding mechanism of a paper cassette.

In each of the first and second embodiments, a description is provided by taking, as one example, an image-forming apparatus which forms an image on recording paper by means of an electrophotographic image-recording device equipped with a paper transport device. However, the present invention is not limited to this image-forming apparatus. For instance, the present invention may be applied to a paper feeder in the paper transport device of the image reading apparatus. Alternatively, needless to say, the present invention may be applied to an image-forming apparatus which adopts an inkjet recording method.

What is claimed is:

1. A method for controlling a paper feeder which includes:

a paper feeding roller which comes into contact with a topmost sheet of paper in stacked sheets of paper to thereby feed said topmost sheet of paper, a retard roller which comes into contact with said paper feeding roller to separate said topmost sheet of paper from a subsequent sheet of paper in said stacked sheets, and a lift plate which supports said stacked sheets of paper to be fed by said paper feeding roller and presses a front portion of said stacked sheets of paper against said paper feed roller, the method comprising:

lifting the lift plate to press the front portion of said stacked sheets without lowering the lift plate during feeding of the paper in a case where said paper is plain paper; and lifting and lowering the lift plate every time one paper is fed in a case where said paper is cardboard.

2. The method according to claim 1, wherein the lifting and lowering comprises:

lowering said lift plate after one sheet of cardboard has been fed and before a trailing edge of said cardboard passes through a contact section between said paper feeding roller and said retard roller, and lifting said lift plate before initiation of feeding of a next sheet of cardboard.

* * * * *